United States Patent [19]

Schnebly et al.

[11] Patent Number: 4,945,969

[45] Date of Patent: Aug. 7, 1990

[54] METHOD AND MACHINERY FOR MAKING A FLAWLESS SHADE PRODUCT

[75] Inventors: John T. Schnebly, Watervliet; Thomas J. Marusak, Loudonville; John A. Corey, Melrose, all of N.Y.

[73] Assignee: Comfortex Corporation, Cohoes, N.Y.

[21] Appl. No.: 254,381

[22] Filed: Oct. 6, 1988

[51] Int. Cl.[5] ..... E06B 3/94

[52] U.S. Cl. ..... 160/84.1; 160/273.1

[58] Field of Search ..... 160/84.1, 172, 265, 160/248, 107, 282, 284, 287, 264

[56] References Cited

U.S. PATENT DOCUMENTS

| | | | |
|---|---|---|---|
| 972,422 | 10/1910 | Whitmore | 160/34 R |
| 984,135 | 2/1911 | Gilman | 160/285 |
| 1,490,754 | 4/1924 | Wagner | 160/248 |
| 1,887,646 | 11/1932 | Johnston | 160/243 |
| 3,292,685 | 9/1963 | Clark | 160/26 |
| 3,537,504 | 11/1970 | Deane | 160/243 |
| 3,855,732 | 12/1974 | Sheaf | 49/425 |
| 4,019,554 | 4/1977 | Rasmussen | 160/84.1 |
| 4,088,157 | 5/1978 | Chen et al. | 139/1 R |
| 4,422,492 | 12/1983 | Bledsoe | 160/84.1 |
| 4,473,927 | 10/1984 | Miller | 24/461 |
| 4,544,011 | 10/1985 | Sawamura | 160/84.1 |
| 4,665,964 | 5/1987 | Zommers | 160/84 |
| 4,683,933 | 8/1987 | Dunbar | 160/273 R |
| 4,712,598 | 12/1987 | Bonnacci et al. | 160/34 R |
| 4,720,137 | 1/1988 | Higgins | 296/138 |
| 4,807,686 | 2/1989 | Schnebly et al. | 160/84.1 |

*Primary Examiner*—David M. Purol

*Attorney, Agent, or Firm*—Schmeiser, Morelle & Watts

[57] ABSTRACT

An extensible and collapsible covering (10) for framed openings. A shade, having periodically emplaced elastic rod stiffeners (28), is motivated over parallel tracks (20) by a movable sill (26). During shade manufacture, stiffeners (26) are inserted into shade pockets by a machine (100) which examines the fabric, excises flaws and creates pockets for the envelopment therein of the stiffeners. The process for flaw removal uses a single pass technique that cuts fabric around a stiffener, reforms it and bonds the cut ends so as to capture the stiffener in a pocket formed thereby.

16 Claims, 13 Drawing Sheets

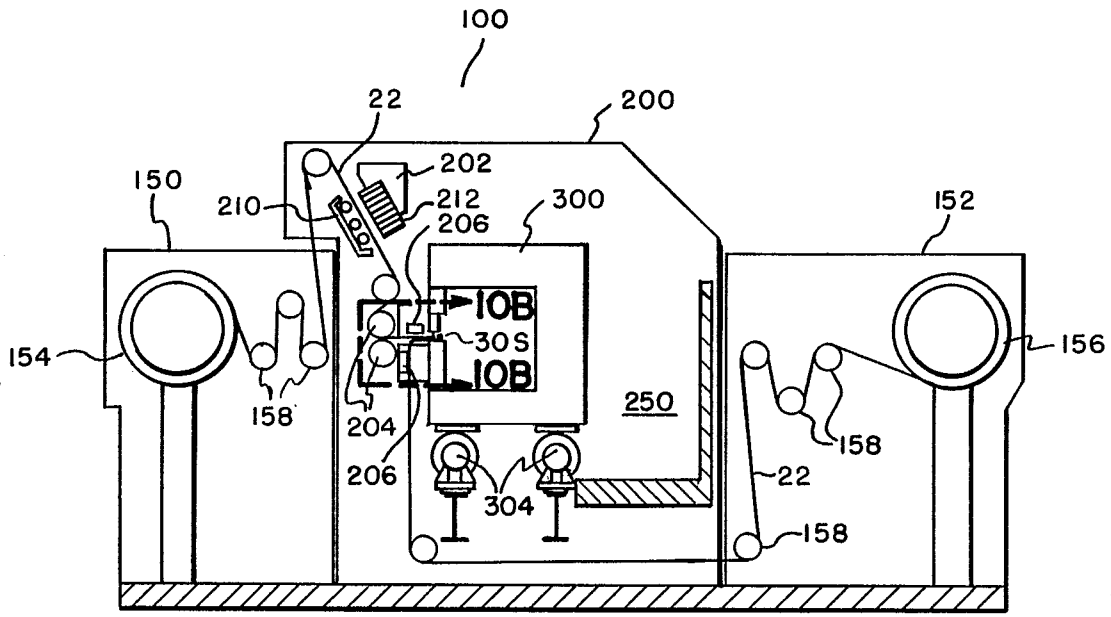
FIG. IOA

METHOD AND MACHINERY FOR MAKING A FLAWLESS SHADE PRODUCT

FIELD OF THE INVENTION

The present invention relates to methods, machinery and products embodying WindoW treatments of the gathered shade type, such as Roman shades and puff shades, and more specifically to a novel gatherable shade that is neither lowered nor taken up by cables or cords; but rather, is driven to fold or extend by the urging of a movable sill or base element to which the shade is attached. The method and machinery disclosed herein relates specifically to unique machinery capable of removing flaws in the shade fabric as an adjunct to the main process of manufacturing the partitioned, foldable shade.

BACKGROUND OF THE INVENTION

The instant inventors have long been engaged in the design and production of coverings for fenestration openings. In both their experiences and after an exhaustive search of the literature and trade journals, as Well as the files of the United States Patent and Trademark Office, they determined that no modality of window treatment, relating to gatherable shades, exists that would be capable of gathering (collapsing) and extending (deploying) a shade fabric without the use of a draw cord(s) or fabric rolling means. In order to avoid the use of numerous pulleys and cords, as well as the shape-deforming shade rolling techniques, both methods currently in vogue through out the industry, the inventors developed and filed U.S. patent application, Ser. No. 07/018,189 for a window treatment system known as SMART SHADE SM (trademark of the Comfortex Corporation and assigned to Hunter Douglas USA, Inc.). The SMART SHADE SM window treatment system consists in a mobile header (sill) element which is used to extend and retract an accordion-type, foldable shade along a pair of rectilinear and curvilinear side tracks that are laterally mounted to fenestration openings. SMART SHADE SM is adaptable to both automatic and manual operation and derives its unique characteristics from a combination of factors involving the header-motivated shade collapse and deployment, the stepped and regularized (constrained) motion of the header over the tracks, a complete absence of gathering-deploying pulleys and cables and the maintenance of an extremely close fit between the shade fabric and the fenestration-mounted tracks so as to create within the space formed by the closed or deployed shade and the outside fenestration covering (generally, a glass window or solid door) a still air plenum. To the extent that the track-engaging, movable header system allows the gathering and deployment of a shade, without use of pulleys, cables or shade rollers, its adaptation from the SMART SHADE system is herein employed. Quite uniquely, however, the instant invention transcends SMART SHADE SM in that it contemplates the usage of a simple planar fabric, or film material, to be deployed over fenestration openings that are both horizontal as well as vertical, using suspension techniques not found in the present art.

In a most recent study of patents dealing with the background art of the instant invention, three disclosures of note, issuing between May and December 1987, were deemed relevant. Zommers (U.S. Pat. No. 4,665,964) discloses a Foldably Extensible And Collapsible Track-Mounted Shade Device For Skylight-Type Window; Dunbar, (U.S. Pat. No. 4,683,933) discloses a Motor Driven Shade Lowering and Raising Mechanism For Atrium Walls; and Bonacci et al. disclose (U.S. Pat. No. 4,712,598) a Screen Door Assembly.

Precedent to the aforementioned current state-of-the-art patent disclosures were those issued to Whitmore (U.S. Pat. No. 972,422) in 1910, for a Curtain, to Clark (U.S. Pat. No. 3,292,685) in 1966 for a Weatherproof Retractable Wall, and to Chen et al. (U.S. Pat. No. 4,088,157) in 1978 for a Hood System For Covering An Automatically Operating Machine.

Zommers discloses a device comprising a foldable, extensible and collapsible shade member as well as means for forming corresponding sets of laterally projecting trunnions at spaced intervals along opposing edges of the shade proper. The trunnions of the Zommers disclosure consist in semi-cylindrical projections which are captured in lateral fenestration tracks and are therein motivated by a series of pulleys and cables. Thus, in 1987, a somewhat remarkable work of art nonetheless relies upon the time-honored technique of motivating shade edges, albeit using shade stiffener and trunnion connectors, by use of pulleys and cables. Somewhat similarly, Dunbar discloses a motor driven device for raising and lowering shades, such shades being comprised of a flexible fabric in which stiffening rods have been inserted transverse the direction of opening and closing. The ends of the rods are suspended by hooks that are insertable in a series of eye and capstan devices which are movably captured in a fenestration guide rail. Motivation of the eye-capstans, carrying with them the rods, is by cable and pulley arrangement. In late 1987, Bonacci et al. disclosed a screen curtain assembly for large door openings in which the curtain is raised and lowered by draw pulley-supported ropes which are vertically threaded through rings sewn in the curtain material. Unique to this disclosure was the use of rod-in-pocket partitions which appeared to segment the door cover assembly and in which the bottom or base rod was weighted to form, in effect, a header element. Nonetheless, the Bonacci disclosure teaches the use of draw rope and pulley apparatus.

More relevant to the instant invention was the disclosure of Whitmore in 1910 for a curtain of flexible fabric and which contained therein parallel, transverse batts which were used to stiffen the fabric in its deployed mode. Extensions at the tips of the batts comprised guides which fitted into lateral double-railed tracks that were mounted along the sides of the fenestration opening. The batt extension, equipped in the alternative with rollers, fitted into the dual-flanged tracks and guided the shade as it was drawn over the opening. The Whitmore shade or curtain was rolled from the top of the opening and thus required an elaborate contrivance at the top of the track guide to allow the batt extensions to escape from the track proper and be rolled thereafter on the takeup reel. Whitmore clearly did not conceive of, and therefore not disclose, the continuous single flange track of SMART SHADE SM which is captured by, rather than captures, the ends or end guides of the moving shade panel. In the disclosures of both Clark and Chen et al., there is again revealed art that is characteristically a usage of the dual-flanged track, combined with stiffening rods that are extended to fit into capturing tracks, as well as the extensive use of pulleys and cables. Although pulleys and cables have been seen to operate favorably in certain, but limited, applications, the instant inventors hasten to point out that in applications where the deployment or retraction of a planar fabric is directed over both horizontal and vertical fields, pulley systems become extremely complex and, should the plane of travel change more than once, practically impossible. Needless to say, a dual flanged track, to provide the curvilinear groove, possesses inner and outer rails (flanges) of differing lengths and thus, were one to employ such a device, it would be necessary to fabricate and install separate track flanges in order to acquire the two radii of curvature. In window treatment systems, both the cable-pulley system and the plural flange/rail device become extremely complicated, costly and difficult to install and maintain.

The instant invention, hereinafter disclosed, obviates the aforementioned problems by eliminating the more onerous techniques and apparatus which have been heretofore used in the art. As will become apparent from the following descriptions, the shade and the machinery/method for its flawless manufacture shall have significant impact on the field.

In order to fully appreciate the method and machinery for the manufacture of the instant invention, the reader is referred to a previously discussed patent issued to Bonacci et al., U.S. Pat. No. 4,712,598, which issued on Dec. 15, 1987. The instant inventors desire to point out that, in this disclosure, one observes the current state of the art in the joining of a fabric (a panel or panels) to the transverse supporting rod structure. Essentially, Bonacci overlaps the trailing edge of one panel with the leading edge of another and, proximate the panel margins, sews two parallel stitches which form a pocket into which the rod or supporting member is inserted. As commonly practiced in the industry, when a continuous fabric or netting is used, being drawn off a continuous roll, supporting structures such as rods may be laid down on the fabric and glued or sewn thereto. Another technique, evident from the Bonacci art would be to simply gather a small portion of the fabric about the rod, catch the rod therein and stitch or sew at the contacting, retroverting surfaces of the fabric that come together around the rod. Machinery for performing these tasks is well known in the art and, although of immense usefulness, can be seen to have considerable limitation should flaws be detected in the fabric and require removal, before inclusion into a finished product.

Presently, should flawed fabric be detected prior to assembly of a shade or viewable window treatment, the manufacturer has one of two options to effect a cure. The process or manufacture may be allowed to continue until a unit product is formed and that unit product subsequently discarded or retailed (at a lower price) as an imperfect or second; or, the manufacturer may choose to halt the fabrication process, cut the material (thus removing the flawed portion), and rejoin the material, preferably at a rod-fabric juncture. As may be readily apparent, both of these processes (the latter being performed manually), not only entail considerable expense but often give rise to products that do not meet the rigid specifications of those produced by the instant inventors.

In order, therefore, to produce a quality product embodying this new form of window treatment, the instant inventors have devised a method of manufacture that, while producing a quality shade product, ensures that the highest aesthetic quality will be maintained by a subprocess which automatically removes flawed fabric and continues the shade fabrication process without the tedium of physically halting the shade fabrication machine and manually or automatically cutting the fabric.

As the reader will soon note, this disclosure defines a new type of shade fabrication for use with the instant inventors' SMART SHADE SM window treatment system which comprises a unique mobile header for retracting and extending the shade fabric. Also, a machine and process for manufacture of the shade proper is also provided that shall prove unique in their nonconformity with the present state of the art as well as their ability to produce a high-quality unit product, devoid of fabric flaws and mechanical imperfections.

SUMMARY OF THE INVENTION

The present invention consists in a collapsible-extendable, essentially planar, transverse rod-stiffened shade fabric which is motivated over a parallel track system that spans a fenestration opening. Collapsible retraction and the expansion, by extraction from a fixed border, is motivated by header which spans the side tracks of the fenestration opening and moves evenly, up and down the tracks, by virtue of header-contained guide and drive wheels so formed as to have circumferential projections and depressions which enmesh the racks, i.e. receptive, serial depressions in the tracks. It further consists in a method for the continuous manufacture of the rod-stiffened planar shade element as the fabric is cast off the source rolls; and, a machine which inculcates the method of manufacture, including a subprocess or submethod, for the continued production of shade product (that is, with support rod insertion) by effecting the removal of fabric discolorations and other imperfections.

To adapt a planar, foldable shade fabric for use with the SMART SHADE SM system, a system wherein a mobile header moves over a pair of geared tracks pushing or pulling a shade proper so as to collapse it towards or from a fixed border or margin, it is necessary to provide not only some form of integral support structure in the flexible fabric panel, but also to provide means for guiding or conforming the path of the integral support structure to the out-rigged, lateral track structure. The instant invention thus relies, to some extent, upon known art in that, at first blush, the integral support structure comprises a series of parallel rod-in-pocket fabrications. Unique to the invention, however, and the novelty allowing its embodiment with the SMART SHADE SM apparatus, is the support guide structure adapted to the ends of the fabric's transverse supporting rods. The support guides that allow the rod-in-pocket fabrication of the shade proper comprise slotted rod tips that are attached proximate the ends of the transverse rods and which are designed so as to engage, or be situate adjacent, the fabric portion of the shade. At a stand-off distance of but a few millimeters, the support guides contain a slotted, or "U" shaped, structure which is designed to slidably engage the tracks that are mounted on each side of the fenestration opening. Colocated in the stand-off portion of the support guide, generally proximate the bottom of the slot, is a toothed notch which is capable of accepting and retaining a cord element, that may be used for additional guidance in the deployed shade structure. Thus, it may be readily surmised that the flexible planar fabric, having therein a series of parallel support rods that are supported and guided by their engagement about the opposing tracks of the previously described SMART SHADE window treatment systems (Background of the Invention), is adaptable for use as the honeycomb "accordion-type" shade which is part of the SMART SHADE system. Further, the tracks used by the instant invention comprise a subsystem support-guide apparatus that in itself comprises two distinct components, the combination of which allows this subsystem to be used in practically any window treatment employing a sliding, retractable-extensible fenestration shade treatment. The opposing tracks comprise in singular ribbonous projections which lie in a plane coplanar to the glazing of the opening for which the retractable-extensible shade covering is being provided. The second portion of the track subsystem, not generally required when the fenestration framework is made of wood or contains therein longitudinal grooves or rabbeting that can accept a track root, is a track retainer element, also a continuous or ribbonous article. The track retainer may be characterized as a adapter element which allows the seating of the continuous, track root therein, and which may be attached to non-grooved or non-groovable surfaces. The most common usage of the track retainer element is to provide a groove for the seating of a track root in a metal window frame. An example of such usage is in greenhouses where, because the metal framework consists of a curvilinear, multipaneled array, it is both impractical and expensive to produce metal framework with specially extruded or machined grooves for accepting the roots of continuous, ribbonous track. The singularity of the track, that is, a track dissimilar to the current planar guide tracks such as found in sliding panels allows the track disposition along the lateral margins or frame of a fenestration opening and permits it to readily pass from vertical to horizontal, and back to vertical, orientations. If one were to seek this character in the commonly used double-flanged or railed track, it would be necessary to construct the track of two separate, ribbonous flanges or rails or to so bend (generally) metal material as to require the handling (i.e. packaging and shipping) of large, awkwardly shaped tracks. This follows because, as one passes from one plane of reference to another, say vertical to horizontal, the radius of the turn would be different for each of the rails or flanges of the track. This is a problem readily recognized to those familiar with railroad technology and becomes just as apparent to those wishing to employ novel and aesthetic window treatments such as embodied in the instant invention.

The process and machine for manufacture of the aforementioned product may well revolutionize the production of transverse rod-supported planar shades. Both process and machine are of the conventional type in that the front portion is identical to that used in the industry today. A feed roll or cast off roll dispenses the fabric, generally known as the web, continuously downstream to the first inspection station. At the first inspection station, scrutiny may be made by human visual or automatic optical means. Generally, if flaws are detected with either process, some form of marking or flaw identification is made, either in computer controller memory (time-control) or on the fabric itself (for optical detection).

The first operation to be performed on the fabric (material) is executed at the rod insertion/flaw removal (RIFR) station. The fabric is introduced to this station by passing it between two rollers, the first a metering roller which is driven by a stepping motor, and the second by a constraining roller known as the nip-roller. The rollers are longitudinally juxtaposed and in tensioned contact with each other and have, covering their cylindrical surfaces, a firm, resilient material, commonly rubber. It is the purpose of this roller pair to drive the material therebetween at a predetermined rate, hence the requirement to drive the first roller by a stepping motor, a motor which, under proper stimulus, moves a predetermined angular distance. The material is sequenced from between the two rollers into the station and past an optical or infrared detector (in one flaw detection option) which determines automatically whether the fabric has been flaw-marked. Flaw detection may be in computer memory in the non-optical option. If no flaw is detected, the manufacture process continues in its primary mode which comprises the following steps: first, at a time pre-determined and set in the machine's controller, a pressure pad is brought into contact with the fabric against a rigid surface of the its flow path, causing an immobilization of the fabric downstream of the metering first roller; the metering roller is then controller-commanded to advance through a single cycle and concurrently, a blast of air is inserted transverse the entire fabric and perpendicular to it, so as to divert the material from its path, at a point between rollers and the point of immobilization, into a second channel of flow; in the second channel of flow, the material is essentially folded back upon itself with the point of fold (or crease) impelled into the second channel of the machine by the continuous air blast to a point proximate the terminus of the second channel, known as the first index, or "A" index; the instant that the fabric crease reaches the "A" index, the stepping motor stops, the upper clamp closes to restrain the material, which action defines and locates the loop at the fold, and a rod is inserted into the fold; at the completion of rod insertion, a major component of the instant invention, the compound traveling stitcher-mender (to be described separately below), traverses the crease setting a stitch or fabric weld, between the second channel terminus and the rod, in order to secure the fabric of the web totally about the rod surface; and, thereafter, the traveling stitcher-mender is removed, a surface integral to the second channel of the aforementioned station is retracted, while the pressure pad which immobilized the web initially is also retracted (concurrently excess rod length is trimmed by associated cutters that flank each side of material in the fold region), and a take-up roller pulls the fabric-rod continuum hack through the second channel and into the remainder of the first channel, as the automatic controller of the machine sequences back to the first step of the normal fabrication process. The reader should now understand the normal operating mode of the shade fabrication machine and the process which it inculcates; however, before proceeding with the disclosure of the apparatus and process associated with the flaw removal mode, a digression to describe the unique traveling stitcher-mender device is warranted.

The traveling stitcher-mender comprises a machine with two heads, arranged in tandem, and which in operation traverses the aforementioned crease of the fabric, very close to the inserted rod. The first head is a conventional stitching or sewing head and is cantilevered over the rod so that its operative area lies between the terminus of the fabricating station's second channel and the inserted rod. In normal operating mode, as the traveling stitcher-mender (hereinafter, "traveler") traverses the seam, the overhanging sewing head sets a stitch and encloses the rod in the fabric pocket (crease). Those having ordinary skill in the art will recognize that the sewing head may be exchanged for the familiar heat weld and anvil heads should the fabric in use lend itself more readily to that means of sealing. In tandem with the sewing head, but on the other side of the rod, is the mending head which has two indices of operation. During normal operation, the mending head is indexed rearward of the sewing head and rod pair so that, although proximate the rod, during the traverse of the traveler it will not come in contact with the fabric encircling the rod. In the fault mode however, the mending head intercepts additionally fed (flawed) material. The mending head itself, gated to and physically disposed behind the sewing head, consists generally in three elements: an arcuate, elongate head, the arc of which conforms to the shape of a rod, and which is used to urge or form fabric about a rod—called the "former", an adhesive application element comprising one or a series of adhesive ejection ports—called the "applicator", and at an end of the former, an extremely sharp knife element called the "knife" which will cleanly sever any fabric encountered during the traverse operation. When the traveler is indexed to enter its flaw removal mode, it will traverse the rod-fabric margin in registry with the rod itself. Depending upon which direction the traveler initiates its operation, the knife, moving along and proximate the rod, cleanly severs any fabric exposed between the rod and the surface of the knife. Since the knife is generally straight (depending upon the diameter of the rod), some fabric will remain that can be drawn about the rod and the two fabric edges joined therewith. The aforementioned operation is performed by the other two elements which are compounded with the knife in the mender head. Immediately behind the cutting knife (whether traversing left or right), the adhesive applicator ejects adhesive onto the rod and the former conforms the fabric cut end together and around the rod so that they meet at the adhesive bead and are thus formed and joined, in a sense welded, to the rod. Concurrent with the mending operation, the sewing head has performed the stitch or welding operation on the other side of the rod and the rod insertion and securing process has been completed.

Having an idea now of the operation formed by the traveling, stitching-mending device, it is now appropriate to describe the subprocess constituting the entire flaw removal procedure. If a flaw has been detected and a marker set, such marker will be controller time-indexed or (optionally) picked up at the flaw marker detection station; and the flaw removal mode will be entered. As in the aforementioned normal operation mode, the downstream, properly fabricated flawless shade will be immobilized, the stepping motor for the metering roller is commanded, by the auto-controller, to double- or dual-cycle and the air injection is commanded to operate commensurate with the dual-cycle of the metering roller. The dual-cycle of both the metering roller and the air injector drive extra fabric, now containing the flawed portion, beyond "A" index to what is termed the "C" index, considerably beyond the station's second channel. The rod is then set in place at the normal index, called the "B" index. Immediately thereafter, the traveler is switched to the flaw removal mode and the compound stitching (at the "B" index) and mending is performed by the traveler, as described above. Immediately after the above-described stitching and mending operation, the normal operation mode is reentered and the second channel restrictive surface retracts to allow removal of the rod-in-pocket assembly. Those familiar with this form of sequential manufacture of continuous roll fabrics, will recognize that the take-up reel is of a form that will readily accept the fabricated shade as it moves downstream out of the fabrication station. In the instant invention, the take-up roll comprises a one-way clutch and slip-drive take-up tensioner and maintains tension on the downstream finished product web. The other minor details attendant the instant invention will be better understood and appreciated after the reader has had the opportunity to read the following detailed description.

BRIEF DESCRIPTION OF THE DRAWINGS

Of the Drawings:

FIG. 10A is a schematic illustration of the machine used in making invention product;

DETAILED DESCRIPTION OF THE PREFERRED EMBODIMENTS

The following detailed description shall address the preferred embodiments for the product, process of manufacture and the machine by which a major portion of the product, the transversely strengthened (stiffened) planar fabric, is constructed and in which flaws found in the fabric sheet or web are eliminated.

Figure 1A:
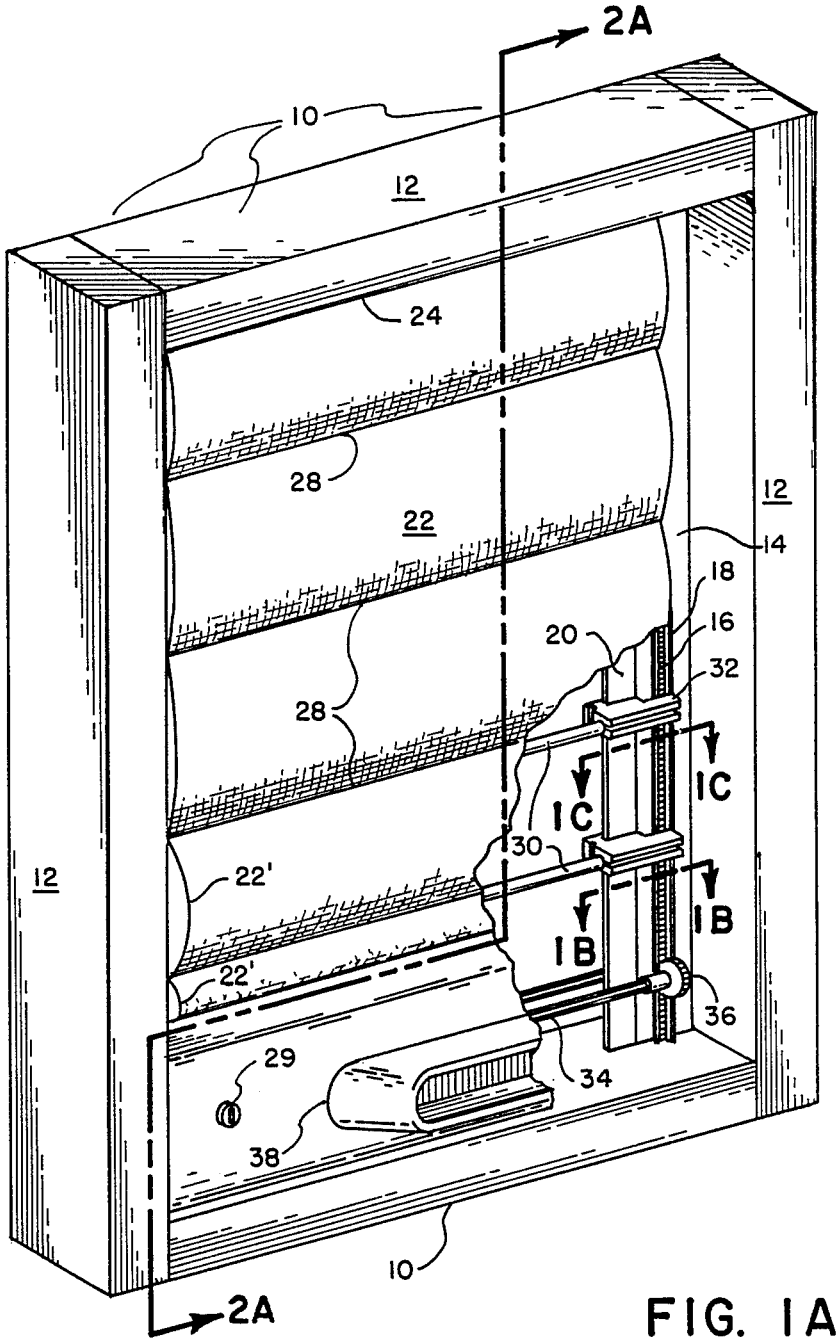
FIG. 1A is an isometric illustration of the invention.

Referring more particularly now to FIG. 1A, there is disclosed therein a stylized rendering of the invention product 10. The salient elements of the product readily seen in this isometric illustration consist in the framework 12 of a typical fenestration (window) opening. Laterally disposed in the framework 12 is a pair of single flanged ribbonous tracks 14, the details of which will be discussed later in the discussion of FIG. 6A. in FIG. 1A, the ribbonous track 14 is shown only in the cut-away portion at the lower right hand corner of the figure. The prominent features that are readily disclosed herein are the toothed track 16 which resides in a cusp 18, found on both sides of the track element 14, and the most prominent feature, the single ribbonous flange 20 which will act both as a supportive and guidance feature for the shade 22 proper. From the illustration of FIG. 1A the reader should take note of the major elements of the invention product 10 that are meant to be, and are, clearly visable to the ordinary user or observer: the shade 22, that is affixed at one margin 24 to a rigid framework such as the top or bottom of a window frame 12, or to a mantle or lintel in other applications; and the apparently sectionalized shade 22, drawable over and collapsible on side rails 20 and which become visable to the observer when the movable header 26 is caused to traverse the track 20. When the header 26 is motivated toward the fixed margin 24, the shade 22 is caused to fold regularly 22' between the stiffened transverse portions 28 of the shade fabric 22. Referring to the lower right hand cut-away of FIG. 1A, the reader may observe that the partitioning apparatus identified as 28 (above) is afforded by a high-elastic-modulus transverse rod 30 which is inserted in pockets (not shown) of the shade fabric 22, or is bonded thereto by suitable means. At both ends of stiffening rods 30 (as they shall hereinafter be termed) are located one of two embodiments of shade support-guides 32, 33. In FIG. 1A, the guides 32 are of the first desired embodiment, the type which are fitted over the tip of the rod 30 engaging not only the rod, but a portion of the shade 22 therewith. This support-guide 32 is further detailed at FIG. 1C, shown in its preferred alternate form (with a different embodiment of the rod), at FIG. 1D and, in both embodiments, discussed in detail with the exposition on FIGS. 5A–5D.

Digressing momentarily, the instant inventors would herein reiterate the salient motivation apparatus of the earlier mentioned SMART SHADE SM apparatus as it now applies to the instant invention. As mentioned above, the movable header 26 constitutes a movable sill that traverses the window side tracks 20. The header 26 is located opposite the fixed sill 24 and to it is attached the margin of shade 22 opposite that attached to sill 24. The internal mechanism of movable header 26 shall be discussed further at FIG. 3 and, details of its track-following adaptation shall be discussed at FIG. 6A. Note that a salient element of the header 26 comprises at least one drive shaft 34, which may be either motivated or placed in an idler-follower mode, and which has as its primary function the mechanical coupling (engagement) of at least one drive wheel 36 (in fact, a toothed or cogged wheel), located at each side of the header 26 to each of the parallel tracks 20. In order to lend clarity to this illustration, it has been necessary to omit a tandem wheel 36' which, like the illustrated drive wheel 36, rides in the cusp 18 located on the opposite side of the track and meshes with (engages) the gear teeth 16 located therein. Those of ordinary skill will recognize that the purpose of wheel 36' is not so much to drive the mechanism as it is to urge the drive wheel 36 into close registry with the cusp 18, so as to fully engage teeth 16. The remaining apparatus, seen in FIG. 1A, consists in the movable header 26 engaging-disengaging handle 38, which will be shown in sectionalized detail at FIG. 3. The purpose of handle 38 is to allow the user to engage motivation means colocated in header 26 or, if desired, to disengage the motivation means (not shown) so as to allow manual propulsion of the header along tracks 20, yet maintain an eveness of header motion (and consequently, shade collapsibility) by assuring that all drive and follower wheels 36, 36' remain properly gated along the identical, parallel track teeth 16.

Figure 1B:
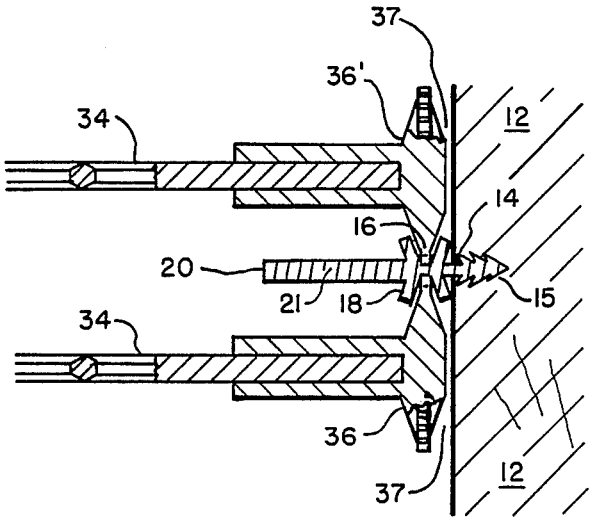
FIG. 1B is a top sectional view of the drive wheel-track apparatus taken vertically at section 1B of FIG. 1A.

A most important feature, indeed a feature without which neither the SMART SHADE SM nor the instant invention would have been possible comprises apparatus that are detailed in FIG. 1B. This top view is a schematic of the detail of FIG. 1A taken at 1B. The reader may clearly observe that drive wheel 36 being motivated by shaft 34 is in close registry with the follower wheel 36' being driven or merely mounted on idler shaft 34'. Indentical counterparts to wheels 36, 36' are located at the other ends of shafts 34, 34'. Each set of tandem wheels 36, 36' rides in the cusp 18 of a track 20. In actuality, the track 20 consists in a single ribbonous flange 21 contiguous with a double cusp 18 bearing teeth 16 in the col thereof, and further contiguous with a root extension 14 and a root 15, comprised of a barbed or other suitable gripping means. In FIG. 1A, the root extension 14 is a portion of the single track retainer. The common practice is to press the root 15 as far as possible into the frame media 12, herein wood, so that the lateral edges of the cusps 18 are in close registry with the frame 12. Note that the beveled shape of the wheels 36, 36' allow the geared wheels to ride in the toothed track, yet maintain a small, but finite, clearance 37 between the frame and the sides of the wheels 36, 36'. The track's projecting flange or tongue 21 may then be engaged by a support-guide 32, 33 in either the end-capping version 32 or the end insertion version 33.

Figure 1C:
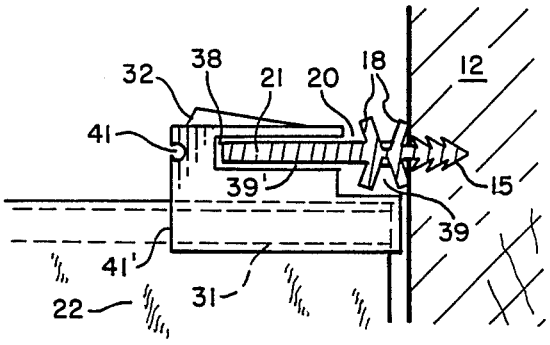
FIG. 1C is a top sectional detail of a rod support-guide riding on the track as taken horizontally at section 1C of FIG. 1A.
Figure 1D:
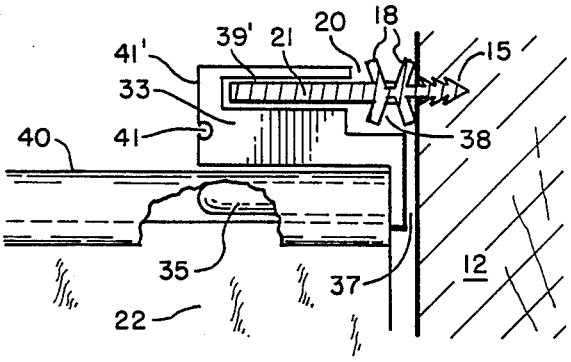
FIG. 1D is a top view of the second embodiment of a rod support-guide similar to FIG. 1C.
Figure 4:
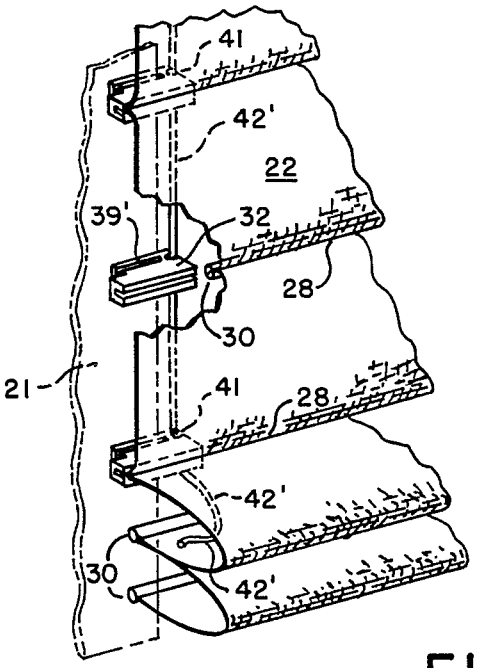
FIG. 4 is a partially cut-away isometric view of the support-guide of the instant invention.

FIGS. 1C and 1D essentially provide the reader with a top view of the 1C section taken from FIG. 1A while employing the rod end support-guide 32 cap type and insert type 33, respectively. Both versions of the rod tip support-guide 32, 33 will be discussed in greater detail at FIGS. 5A through 5D. In FIG. 1C the track 20 is inserted by its root 15 into the frame 12. Generally a groove or rabbet is provided of narrower gage than the track root 15 so that, once inserted into the groove, the root 15 with it retrograde restrictive means (here, barbs) cannot be easily removed. A groove of sufficient depth in the frame 12 will allow the tracks 20 to be seated close enough so that the outside margins of the cusps 18 rest snuggly against the framework 12. In the first support-guide 32, the rod end cap version, the reader can appreciate (FIG. 1C) that the shade 22 is brought into very close registry with the frame 12. This facility derives from the fact that the rod end cap version of the support-guide 32 fits over the rod-in-pocket portion of the fabric 22 completely but for approximately 1–1.5 millimeters of the support-guide tip. Further to the support-guide, end cap version 32, there is a vertical slotted portion 38 having two depths, a wide cut 39 to accomodate registry with and along the cusp 18 of track 20 and a slot orthogonal thereto 39' to accomodate insertion of the track tongue 21 therein. The registry of tongue 21 in slot 39 of support-guide 32 is a close registry, but also one of fairly easy slidability. The support-guide must not only provide fairly rigid support for the rod 30 to which it is appended, but it must also he capable of smooth, easy movement over the main guidance framework, that is, the tracks 20. Relative to the support-guide insert version 33, the pictorial cross section in FIG. 1D details all the salient elements found in the end cap version 32 with the notable exception that, because this embodiment of the invention entertains use of a longitudinally-split hollow rod 40 and the inventors have no desire to produce an end cap version 32 large enough to fit over the end of hollow rod 40, the most logical alternative is to provide the same interactive elements of the first-described version with a means for appending it to the hollow rod. To this end, support-guide 33, slidably registrable with track 20, through the slidable registry of vertical slot 39' with tongue 21 and cut-away 39 with cusp 18, is provided with a stand-off rod insert 35 that may be inserted into the tips of the hollow support rods 40, thus effecting the same vertical slot 39' relationship with the hollow rod 40 as was achieved with the end cap support-guide 32. Finally, in order to provide means for assisting the extension of the panel 22 at the urging of the moveable header 26, the inventors employ a connection of the sequentially aligned support-guides through a slender, flexible cord that is inserted into the support-guide (cap version 32 or insert version 33) and secured therein by capture in the cord "C" shaped trough 41, a groove that has been provided colinear to slot 39' along the inside margin 41' of the support-guides. It should be understood that the connector cord 42 (shown only in FIG. 4) is not obligatory for one practicing the invention but, in instances wherein the invention is applied to a fenestration opening which effects a curvilinear path, it is highly recommended and serves to maintain a proper spacing of the support-guides without placing undue stress on the shade 22 during its extension.

Figure 2A:
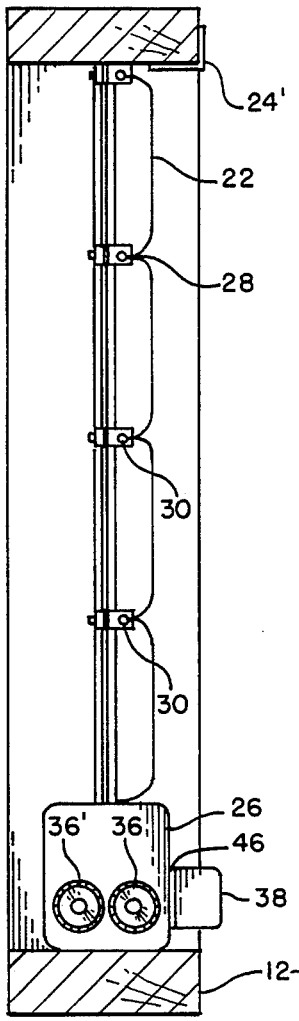
FIGS. 2A and 2B partially sectionalized side views of the FIG. 1A apparatus in fully extended and partially retracted postures, respectively.
Figure 2B:
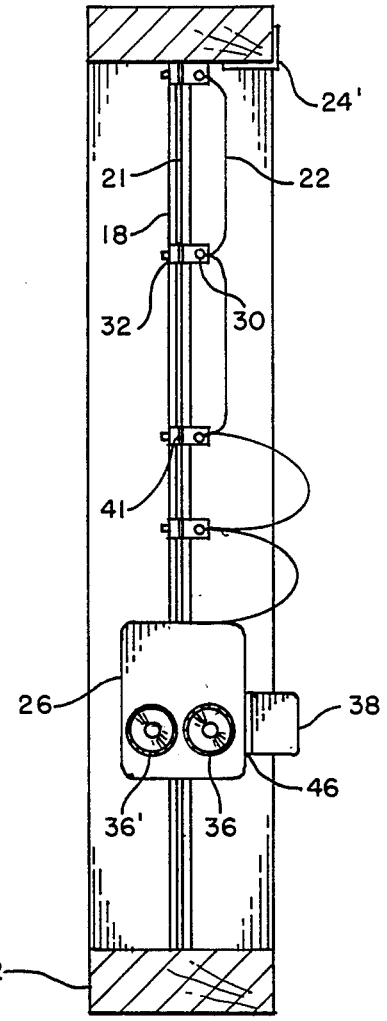
Figure 3:
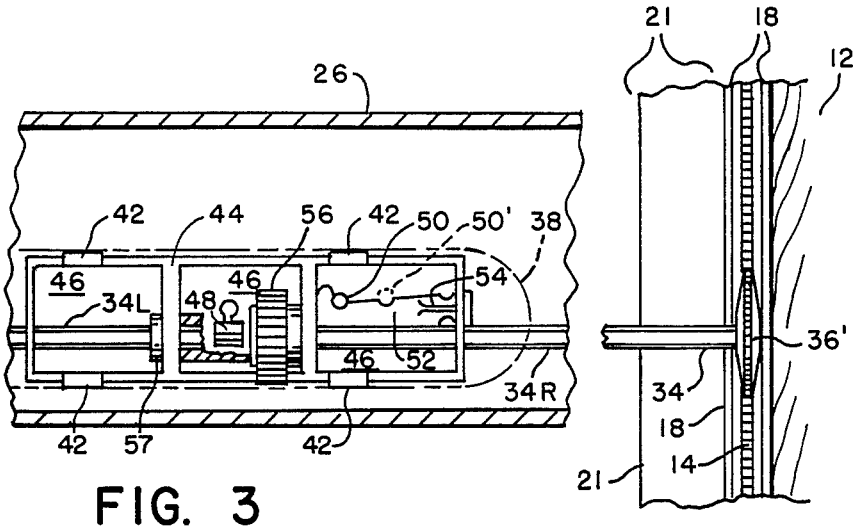
FIG. 3 is a partially sectionalized front view of the mobile header element disclosing engagement-disengagement mechanism for header driver-follower mechanism.

FIGS. 2A and 2B are partially sectionalized side elevations of the invention in its fully extended and partially retracted modes, respectively. All part numbers retain their previous identification and nomenclature with the addition of the decorative fixed sill angle iron 24' which is illustrated herein as one possible means for affixing the top, fixed margin of shade 22. FIGS. 2A and 2B are elevations of FIG. 1A sectioned, as indicated in FIG. 1A, at 2A. Thus, the left end of header 26 is shown bearing drive wheels 36, 36', the left hand side of the moveable header; while, portions above the header 26 reflect the cross sectional view of FIG. 1A taken at a point between the side rails and the inside edges of the support-guides 32. Also not disclosed under previous drawings, because it will be discussed in more detail during the exposition on FIG. 3, is handle 38 and butt plate 46. Rigidly affixed to the handle 38, the butt plate 46 provides a means for attaching additional mechanism peculiar to the engagement-disengagement apparatus.

Although it may be considered of mere passing interest in this disclosure, since it was the subject of the aforementioned SMART SHADE SM patent application, now allowed, the header 26, because of its high degree of utility in the instant invention, is disclosed briefly with reference to FIG. 3. This figure is a sectionalized, cut-away representation of the header element—including the engagement-disengagement mechanism, a right side track 20 clearly delineating the track tongue 21, with cusp 18 (and teeth 16) inserted into the wood frame 12 and engaged drive wheel 36 driven by shaft 34. As explained earlier, it is not necessary that shaft 34 be motivated; however, in the absence of any other form of motivation, such as the motor used in the SMART SHADE SM system, the header will have to be motivated manually after disengagement of the motor (not shown) by actuating the engagement-disengagement handle 38. Because the detail of FIG. 3 is concerned only with the engagement-disengagement mechanism of the header 26, the manner in which the header is secured to the track and by which it compels the constant registration of drive wheels 36, 36' with the track teeth 16, shall be deferred until the discussion of FIG. 6A. Referring particularly to FIG. 3, the engagement-disengagement mechanism is illustrated within the area defined by the dashed lines representing the external handle 38. For the sake of clarity and, in the desire to avoid redundancy relative to the SMART SHADE SM disclosure, the following discussion shall be directed toward a mechanism which merely locks (disengages) and unlocks (engages) the drive mechanism, that is the moveable header 26, of the instant invention. Those of ordinary skill will realize that a locking-unlocking mechanism may be redundantly employed in a header to engage, disengage and concurrently lock and unlock a drive shaft/gear network to, or from, motor drive means. The mechanism preferred in the instant invention for engagement of the drive wheels 36 may be readily ascertained by reference to the rear, cut-away view of the header 26 at FIG. 3. The dashed lines represent the external frame of the actuating handle 38. Handle 38 is moveable both left and right with reference to header 26 and when urged to do so it slides on flanges 42 which slidably engage the frame of the lock case 44. The flanges 42 are rigidly secured to handle 38 backing plate 46 which is a solid planar element and has mounted thereon a pawl 48 and at least one orthogonally projecting detent 50. Pivotally mounted to the side of box 44 is spring 54—biased detent engagement lever 52. Two notches in lever 52 allow the spring biased lever to engage detent 50 when handle backing plate 46 is moved so that detent 50 moves into the 50' position. When this is done, fixed pawl 48 engages gear 56 which is securely fixed to shaft 34 R. Thus, the fixed pawl locks rotating shaft 34, securing the mechanism (header 26) in its position at the time of disengagement from the motive means. Those of ordinary skill will recognize the fact that, as in the SMART SHADE SM invention, concurrent with the locking of the shaft (pinion) gear 56, additional apparatus on backing plate 46 disengages the motive means. Although not specifically detailed here, the reader should also note that it is possible to use the instant mechanism to disengage a motor drive through shaft 34L and sleeve 57 by manual movement of the handle to the detent 50' position to lock the mechanism. Many methods of acquiring such motivation and engagement-disengagement activity are available to those trained in the mechanical arts and it is not the purpose of this disclosure to go into any further detail regarding same.

Having been apprised of the method and apparatus used to motivate the shade 22 into its collapse-extend modes, it is now incumbent upon the instant applicants to further detail the primary support-guidance mechanism of the invention. Reference now being made particularly to FIG. 4, there is disclosed in partial isometric cut-away the shade 22, periodically partitioned by transverse rods 30, and stiffened thereby. At the end or tips of each rod (only a few are disclosed herein) are seated support-guide 32 end caps having therein vertical slots 39' by which they engage track 21 (shown in phantom). Further to maintenance of the periodic separation between support-guides 32 is the strain cord 42' (also shown mostly invisible, but partially visable). It may be readily seen that the combination, as well as the cooperation, between support-guides 32 (and, in alternative embodiments, guides 33) and the parallel tracks 20 perform the dual function of guiding the header and stiffened shade combination (with stiffening apparatus such as rods 30) while providing all of the support necessary to the suspension of the invention over any surface, whether horizontal or vertical. In fact, the unusual combination of functional elements within the instant invention not only lend to it the characteristics of high integral strength and durability, but concommitantly grant it broad versatility without the need for additional or adjunct apparatus. Noteworthily, adjunct apparatus relates more to fenestration frame work and consists in only two types of devices which will be explained more fully in the discussions of FIGS. 5A–5D and 6B–6E, an alternate version of stiffening and support-guidance for large, heavier shades and retention means for the parallel tracks, respectively.

Figure 5A:
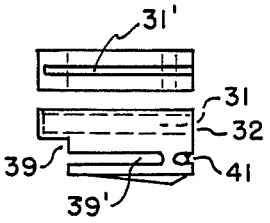
FIGS. 5A and 5B are orthographic representations of one form of solid rod end support-guides.
Figure 5B:
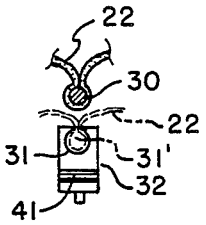
Figure 5C:
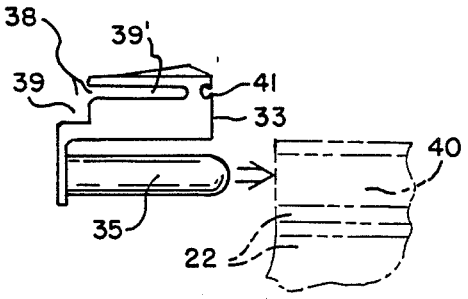
FIGS. 5C and 5D are top and side elevations of an alternative rod and support-guide, for hollow rod usage.
Figure 5D:
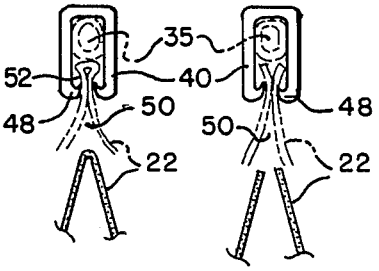

Reference being had now to FIGS. 5A–5D, there is shown firstly, in FIG. 5A, a top view (lower illustration) and a side elevation (upper illustration) of the rod end capping support-guide 32. All parts of this element having been previously described herein, the reader's attention is called particularly in this illustration to the top view of support-guide 32, particularly to slot 31' which is contiguous with rod receiving channel 31. The purpose of slot 31' is to allow the shade fabric 22, outside of the rod-encircling portion, to pass out of chamber 31. This is pointed out more clearly in FIG. 5B, an end elevation of the lower drawing in FIG. 5A. Herein it may be readily discerned that rod 30, in a pocket of fabric 22 (upper illustration), may be inserted colinearly into chamber 31 and rigidly secured thereby. Secondly, in the alternative stiffening embodiment, digression has been made from the basic rod 30 design to that referred to in the detailed description of FIG. 1C, an essentially elongate, hollow rod 40 design having a cross section in the shape of a stylized "C". Reference to FIGS. 5C and 5D reveals the salient aspects of the hollow rod 40 tip support-guide 33 and the manner of shade 22 fabric cojoining (arrow) with the hollow stiffening rod 40, respectively. The reader's attention is first called to the support-guide 33 of FIG. 5C and the elements that it has commonly with rod cap support-guide 32, namely, track tongue 21-receiving slot 39', as well as cusp 18-receiving slot 39 and spacer cord-receiving trough 41. The unique nuance of support-guide 33 is the off-set rod 40 insertion tongue 35. As may be discerned from the illustration, tongue 35 is inserted into the ends of hollow rods 40 which already have captured (or been affixed to) shade 22 fabric. FIG. 5D represents, in cross section, two methods of inserting shade fabric 22 into the open portion of hollow rod 40. In the left hand view, a continuous fabric of shade 22 is transversely folded and forced into the lateral opening 50 of the "C" shaped hollow rod 40. Attention is called now to the recurved internal portions at the ends of the "C" cross section of hollow rod 40. It is the purpose of these recurved margins 48 to prevent retrograde motion of either the folded shade 22 fabric or the paired, cut ends (as seen in the right hand view) when the fabric is inserted into the rod openings 50. It should be noted that rod end support-guide 33, with tongue 35 inserted into hollow rod 40, has sufficient clearance, as illustrated in FIG. 5D, to avoid either the folded fabric bead 52 or cut ends 52'.

Figure 6A:
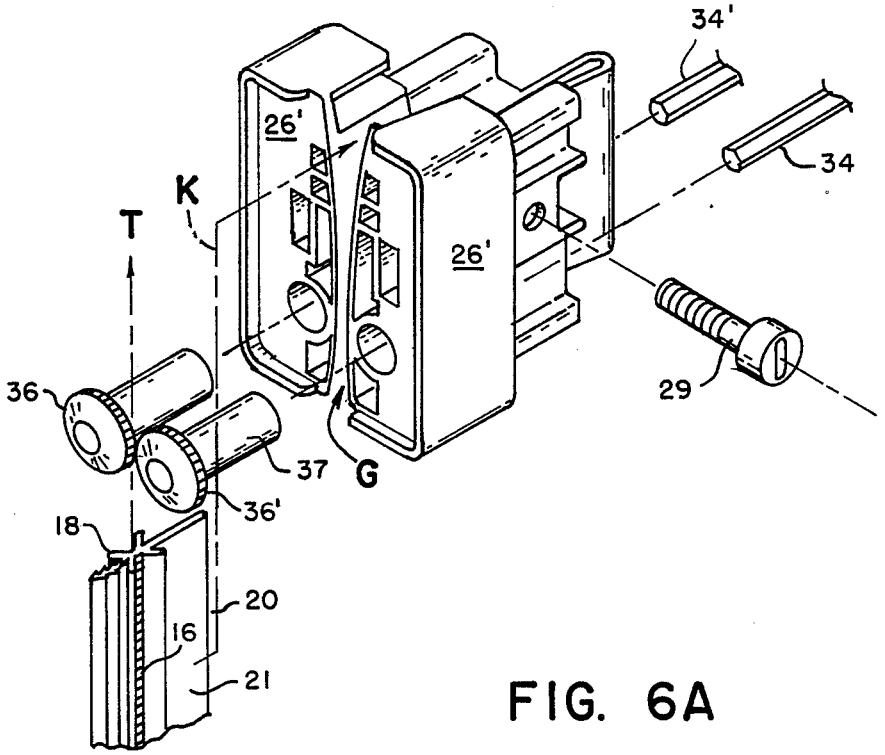
FIG. 6A is an exploded isometric view of the header element and cap showing tandem drive wheels superposed over the continuous ribbonous guide track of the invention.

The remaining apparatus, peculiar to both SMART SHADE SM and the instant invention shall now be described with reference to FIG. 6A.

Having now given a detailed description of the major components comprising the invention product, it is proper to digress in order to take up a brief review of the motivating apparatus which drives the shade 22 to collapse and extend. Although discussed in the summary, as well as in the detailed description of the FIG. 1A apparatus, the header 26 should be further explained as to the manner in which the drive wheels 36, 36' are caused to engage track cusps 18, to be held in registry therewith, and move along toothed portions 16 as the ends of the header 26' encompass and traverse tracks 20. Referring more particularly now to FIG. 6A, the essential apparatus for carrying out, according to the instant invention, the aforementioned process consists in but a few essential elements which comprise a number of those found in the SMART SHADE SM system. The reader should recall, from the exposition of FIGS. 2A and 2B, that the header 26 possesses what may be described as end caps 26', through which project the drive/follower shafts 34 and which hold the drive shafts 34 in engagement with wheels 36, 36' by conventional means such as shaft-in-sleeve mechanism 37 or other suitable means. The reader may observe from the FIG. 6A illustration that both halves of the header 26 end caps 26' are spring biased, by spring clip 27, in order that they may be held in close registry. It can be seen that the projection or tongue 21 of track 20 is insertable into the channel G which exists between both havles of the end caps 26'. Thus, when tongue 21 is inserted into the channel G in the manner suggested by the directional line K, wheels 36, 36' may be caused to seat on their respective side tracks of cusp 18 so as to engage the teeth of the wheels (or frictional elements thereof) with the tracks' teeth 16 (or suitable friction means) and effect the tractor motion supplied through rotating shaft 34. The firmness of registry, that is, the amount of tension between the two halves of the end caps 26' is readily adjusted by the tensioning on bolt 29, or similar means. As can be readily seen now, it is necessary to provide traction or drive to only one shaft 34 while, as in the SMART SHADE SM sytem, wheels 36' (or wheels 36) may be cojoined by another idler shaft 34' and employed only to work cooperatively with the drive wheel in maintaining firm registry along track cusp 18.

Figure 6B:
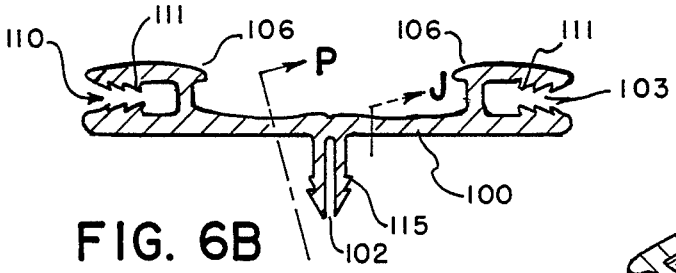
FIG. 6B is an end sectional view of a continuous dual track retainer element.
Figure 6C:
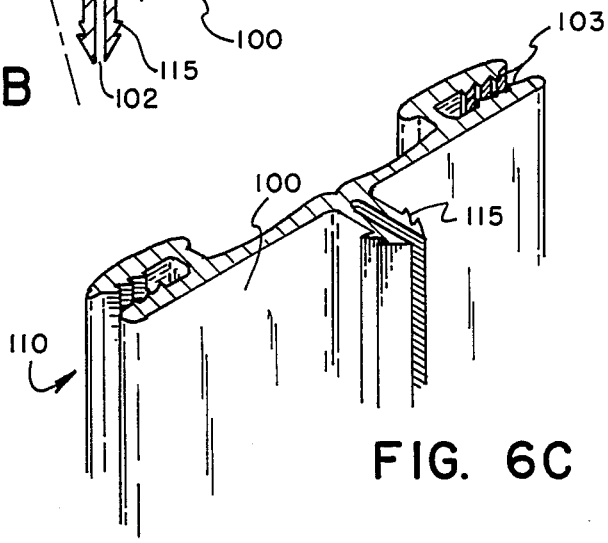
FIG. 6C is partial perspective end illustration of the element in FIG. 6B.
Figure 6D:
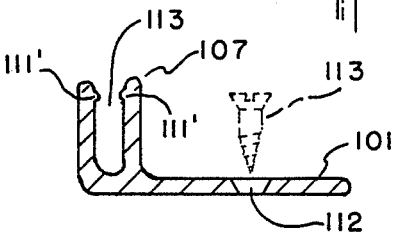
FIG. 6D is a cross sectional illustration of a single track retainer element.
Figure 6E:
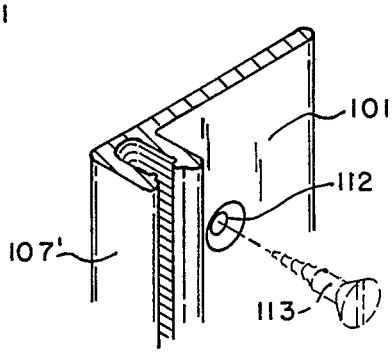
FIG. 6E is an end sectional perspective of the single track retainer of FIG. 6D.

Up to this point, the instant invention, as well as the invention from which its motivation means was derived (the mobile header and associated track system), have been discussed only in the context where its usage would embody a wooden frame sytem. In cases, however, where an existing fenestration system employs nonmachinable framework, it becomes necessary to provide some form of rooting device in order to accomodate track roots 15 so that tracks 20 might be properly situated, in opposition, in order to receive the major elements of the instant invention. FIGS. 6B through 6E relate to two versions of track-adapter elements known as the Dual Track Retainer (FIGS. 6B and 6C) and Single Track Retainer (FIGS. 6D and 6E). Reference being had to the Dual Track Retainer ensemble, there is disclosed a flat, ribbonous and essentially straight strip 100 of rigid material such as high temperature resistant plastic or aluminum. FIG. 6B is a cross sectional representation of the Dual Track Retainer, while FIG. 6C is an end sectional isometric illustration thereof. The salient features, contiguous with the basic strip 100, comprise the centrally located track root 115 which bears a marked resemblance to the track root 15 of the track 20 employed in the invention. The difference between the track root 15 and the track retainer root 115 is the central slot 102 running throughout the length of retainer root 115. The primary function of retainer root 115 is to accomodate the attachment of the Dual Track Retainer to the external or internal framework of individual, yet adjacent, fenestration frames. In most such frames, particularly of the extruded aluminum type, there exists a gap between the frames so as to allow the imposition of root 115 thereinto. In an alternate version of the Dual Track Retainer (not shown herein), the inventors dispense with the retainer root 115 and merely provide other suitable means for affixing the retainer strip to the surfaces of the fenestration frame. In the later discussion of FIGS. 6D and 6E, such an attachment means will be discussed. The remaining relevant apparatus of the Dual Track Retainer comprises at least one means for attaching track 20 root 15 to strip 100. This means comprises track root 15 retention head 106. Root retention head 106, as may be seen clearly in FIG. 6C, is a set of jaws 103, having a gap 110 therebetween and running contiguously the length of strip 100. The jaws 103 face outward with respect to the central root 115 and are meant to receive track 20 root 15 therein. The reader will notice that with such a device as a Dual Track Retainer centrally mounted between fenestration frames, at least one of the parallel tracks 20 may be root-mounted therein so as to form one half of the guide track structure necessary for a single unit of the invention. In instances where it is not feasible, nor possible, to employ the entire Dual Track Retainer, but a retainer of this type is required, (for mounting outwardly or inwardly of the fenestration opening), it may be manufactured in a longitudinally truncated version by cutting along the lines P, or J, as required. This variation, however, is readily apparent to those skilled in this particular art. Notably, it may be seen that the inventors have contemplated production of the Dual Track Retainer sans root 115, containing other mechanism for adhesion to a fenestration frame (such as screwing or stapling) and envisioned manufacture of strip 100 with means running longitudinally, i.e. coextensively with root slot 102 that would allow, by fracture therealong, the separation of one set of jaws 103 from the other set so that a single strip of the Dual Track Retainer may be utilized to provide track 20 root 15 retention head 106 on each side of the fenestration opening.

The Single Track Retainer is a more modest approach to solving the problem of the non-grooved or non-rabbitted fenestration frame. Here an "L" shaped device consisting of a ribbonous strip 101 is provided with a contiguous, orthogonally positioned root 15 retainer jaw 107. It may be readily seen that the track 20 root 15 would be insertable into gap 113 of jaw 107 and retained therein by engagement with nodes 111' in much the same fashion as they would have been captured by teeth 111 of retainer jaws 106, as seen in the Dual Track Retainer. As was discussed earlier and shown in FIG. 1A, the orthogonal flange or strip 101 of the Single Track Retainer is placed on the inside of the fenestration opening, allowing the track root 15 receptor 107 to project orthogonally therefrom and face its oppositely disposed member, at the other side of the fenestration opening, clearly adapted for presenting the track 20 projections 21 opposite one another as previously disclosed in FIG. 1A. A brief reference to that figure will apprise the reader of the fact that the earlier mentioned track root extension 14, as disclosed in FIG. 1A is, in reality, one of the oppositely disposed faces 107' of the Single Track Retainer. In this particular version, the means for affixing the Single Track Retainer is quite simple; ordinary screws 113 are used to affix the flange portion of the strip 101 to the inside portion of the fenestration frame through predrilled holes 112 or by other forms of adhesion.

Having thus disclosed and explained the apparatus comprising the preferred embodiment of the invention product, the inventors propose to reveal a few methods for effecting the ostensible rod-in-pocket structure of the shade proper, define the most cost-feasible embodiment thereof, and disclose the unique method and machinery for producing the preferred stiffened shade embodiment. Relative to the shade-rod structure, there are presently three methods envisioned by the instant inventors for acquiring the desired apparatus and such are detailed in FIGS. 7, 8 and 9.

Irrespective of the physical structure, the methodology presently employed by the inventors is a two-step process comprising the partitioning of the fabric 22 into a series of parallel segments and the addition of some form of stiffening along the borders of partition or demarcation. Thus, the shade product may be realized by the demarcation, whether it is marking, folding, cutting or all three, and a rigidification along the lines or border of demarcation, whether it is adhesion or sewing to a rib or fabric encaPsulation along the border to form a rib.

Figure 7:
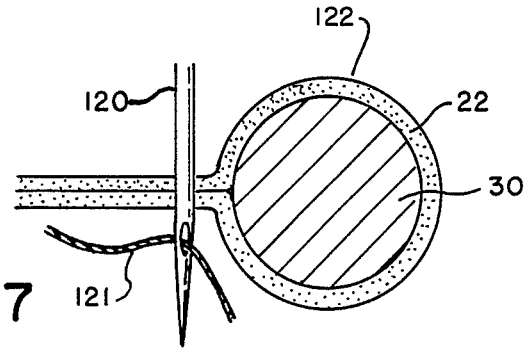
FIG. 7 is a schematic section of the support rod stitched-in-pocket.
Figure 8:
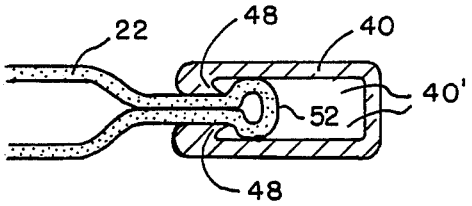
FIG. 8 is a schematic cross section of a fabric inserted into the retaining hollow "C" sectioned rod.

The first, known simply as the sewing or stitching method, is depicted in FIG. 7. Herein, one views the rod 30 and shade fabric 22 in cross section. The fabric 22 is brought around the rod 30 and stitched, by conventional sewing needle 120 and thread 121 close enough to the circumferential margin of the rod 30 so as to effectively capture the rod within the pocket 122 formed thereby. In FIG. 8, the cross sectional illustration reveals the ostensible rod-in-pocket apparatus using the hollow, split rod 40 which was first discussed during the exposition on FIG. 1D. In reality, this is not a true rod-in-pocket embodiment but rather a "captured" arrangement in which the fabric 22 is transversely folded and forcibly inserted into the transverse opening of the generally "C" or "U" shaped hollow rod 40. Once again as in FIG. 5D, the reader may see (perhaps more clearly), the gripping effect afforded by retaining edges 48 to prevent retrograde motion or back-movement of the inserted fabric 22. Whether node 52 is employed (or, as discussed in FIG. 5D, the fabric is transversely cut and both margins are inserted into hollow rod 40), appears irrelevant in that the gripping action of retainers 48 will prevent any retrograde motion of the fabric.

Figure 9:
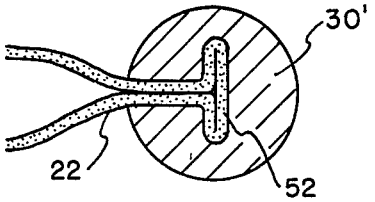
FIG. 9 is a stylized schematic cross section of rod-fabric encapsulation technique.

The shade-rod configuration of FIG. 9, although invented by the instant inventors and certainly providing a viable alternate embodiment, will not be discussed in too great a detail. Briefly, this method of obtaining the pseudo rod-in-pocket structure, most analogous to the FIG. 7 embodiment, consists in placing the folded portion, node 52 element of FIG. 8, or the separate margin embodiment of FIG. 5D, into a stationary mold having a mold cavity similiar to the cavity 40' of FIG. 8, and filling that cavity so as to surround node 52 with a rapidly curing plastic or other suitable composition. As the reader shall note, when reading the remainder of this disclosure, the instant inventors are particularly adept at devising moving types of forming apparatus. That is, as the sewing needle 120 of FIG. 7 traverses the fabric, effecting the stitch, other activities such as, cutting, mending or the applying of an adhesive are also employed, dynamically. Therefore, the instant inventors have also sought and developed methods and apparatus for effecting the "encapsulated" version of shade-rod combination disclosed in FIG. 9. Beyond the suggestion of such an apparatus, as presently disclosed herein, further aspects of this unique invention shall be reserved for later patent activity.

Having now provided the reader with a detailed description of the apparatus, as well as possible variations for practicing the invention, it is appropriate to take up the discussion of a preferred method of manufacture and the unique machinery for performing such manufacture. Hereinafter, reference will be had to the remaining figures accompanying this disclosure, notably FIGS. 10A–13. The inventors' reasons for developing the hereinafter described machinery is simply to provide a means for rapidly, reliably and inexpensively inserting stiffening elements transverse to the run (i.e., a continuous sheet) of a flexible fabric at accurately-controlled, regular intervals. Such periodic stiffening is done to allow the finished shade to be slidably suspended in any non-vertical orientation while suffering minimal visible sag and minimal induced friction between the sliding elements of the mechanism. Additionally, the machine also provides for the removal of existing fabric flaws which would be visible and detract from the aesthetic appearance of the finished product. The unique machine, thus provided, compounds the operation of rod insertion (i.e. the stiffening process) and flaw removal. This compound feature contributes greatly to the economy of operation by allowing the use of somewhat less than perfect material while producing a final product which is devoid of visible imperfections.

Having previously discussed the apparatus of FIGS. 7–9, the following summary concerning materials, in general, is offered so as to prepare the reader for the concepts and inventors' preferences that have been incorporated into the production mode and the machinery therefor. The first means chosen for the stiffening process is a method in which the fabric is transversely gathered, that is, uniformly across its width, into a fold or loop. Into the loop is placed (in the actual sequence of manufacture) a rod of suitably high elastic modulus material (one which intrinsically resists bending). The loop of material is then sealed around the rod, either by stitching (which is the preferred method) or other suitable means such as gluing or welding. The rod fixing method is then employed at periodic intervals along the length of the material or fabric in order to produce a transversely stiff lengthwise—flexible material that can be slidably suspended between parallel tracks, the tracks being arrayed along the material's (shade's) edges perpendicular to the stiffening rods. It is this machinery with its highly stylized and unique method of rod insertion and flaw removal that will be used as the basis hereinafter for the description of a production which rapidly and accurately converts flat goods to stiffened, or segmentally supported articles.

It shall become clear that much of the subsequent description will be applicable to other means of transfer stiffening. For example, a second means for providing the stiffening of the planar or flat goods involves the same gathering of a loop in the material to be stiffened, uniformly across its width, and alternatively pressing the loop into the cavity of a hollow rod by inserting in into a straight longitudinal slot. The rod would have a characteristic "C" shape and bear the same general appearance as to that illustrated in FIG. 8. As was noted therein, the "C" rod cavity is internally barbed or provided with suitable means so that the material loop, once pressed into the cavity, may not readily be extracted. A third option to proVide the requisite stiffening is simply to gather the loop of material, transverse to the length of the material, and encapsulate the loop in an adhesive or binding composition which, on curing, rigidifies the entrapped material into a form of exoskeletal rib (FIG. 9).

The aforementioned alternate stiffening methods share a number of common subprocedural requirements with the preferred (stitching) process. Specifically, all of the methods described require a means for precisely metering the advance of the material to be stiffened in order to assure the uniform spacing of the stiffeners. All methods require that, at these precise intervals or periods, the material sheet or web be gathered into a uniform transverse loop and held securely for the actual stiffening process. All the methods require a traversing device to make permanent the stiffening i.e., a stitching line, an insertion tool (e.g., a roller such as that used to fit or insert the retainer grommet in a window screen), or a binder applicator. Common also to all of these methods of manufacture is the concurrent curing, either photo-optically, thermally or by other radiative energy means, of any adhesive or binder compositions that are used throughout the fabricating process. It will be seen that the machine to be hereinafter described can easily be used to provide a wide range of related applications for accomplishing the desired periodic transverse stiffening.

Having disclosed and reviewed the disclosure of the options available for providing transverse stiffening, it is now appropriate to take up discussion of the machinery which is used to fabricate the invention employing the preferred method of structuring, that is, the stitching or sewing method of FIG. 7. Referring now to the illustration of FIG. 10A, there is illustrated a schematic representation of the machine 100 that is used in fabricating the shade product of the invention. It consists in three subsections, the supply section 150, the take-up section 152 and the rod insertion and flaw removal (RIFR) section 200. The first and third of the aforementioned sections perform operations in keeping with their titles and, for all practical purposes, are considered standard in the industry. The first, the supply section 150 comprises a supply reel 154 from which the planar fabric is cast off into the reel tensioner network 158. Similarly, take up section 152 consists in a take-up roll 156 with reel tensioners 158 practically identical to those of the supply section 150. Because the product taken up is physically different from that cast off from the supply section 150, it should be readily understood by those skilled in this art that the stylized representation of FIG. 10A is given merely for expository purposes. It is the intention of the applicant, in providing this disclosure, to concentrate on the apparatus and methodology employed in the central section, RIFR 200. In the center section of FIG. 10A, the reader views the most salient elements of the instant invention: the photo-inspection station 202; metering rollers 204; looping clamps 206; and the stitching-mending station 300; all of which are situate directly in front of the operator station 250. In the FIG. 10A illustation, apparatus immediately in front of and including a portion of the mending apparatus is sectioned at 10B and will be discussed hereinafter. In the normal sequence of manufacture, the fabric material is cast off supply section 150 and enters the RIFR 200 section at the upstream portion of the photo-inspection station 202. In order for the flaw removal portion of the manufacturing cycle to be activated when flaws actually occur in the material, the means required for identifying flaws in spacial relationship to the segment of material that is to be stiffened are employed at this point. Such a means, photo-inspecting and indexing of the material is provided automatically, but backed up by human visual observation. As the material approaches the metering rollers 204, from the supply section 150, it is made to pass over a smooth surface which emits light, such as a back-lighted translucent panel. The light used may be either visible or of some wave length that is readily adaptable to detection of the variations in translucency or opacity of the material. For the sake of clarity, the salient portions of the photo-inspection station are depicted, in gross, as the light source 210, in stand-apart registry with the detector array 212, and with the material 22 passing therebetween. The photo detector array 212 comprises a line of discrete photo detectors which are caused to traverse the material being inspected. The actual line of detectors is parallel to the material travel and essentially as long as a single material advance increment x, to be discussed hereinafter in greater detail. The sensing area (aperture) of each detector is immediately adjacent the neighboring detectors in the line, and the aperture size is smaller then the smallest flaw to be detected. At each cycle of the machine, between advances of the metering rolls, the detector 212 traverses the width of the material below it, across a band of material which is one advance increment wide and spaced exactly an integral number of advance increments from the material at the rod 30S, currently at the stitch position. As the detector array 212 (also termed "line") traverses the material 22, a signal is produced which is dependent on the intensity of light sensed passing into a discrete detector. Since the non-flawed fabric is regular in its opacity/translucency, the generated signal is steady within some definable range for the non-flawed material. If a flaw in the form of a void, such as a tear, hole or missing/dislocated fiber exists, a detector superimposed over the flaw, will detect more light than normal from the emitting surface behind the material, thus increasing the signal generated beyond the normal range. Should a flaw in the form of a dense spot, that is a knot, coating excess or previously applied flaw marking tag exist, the detector passing over that flaw will receive less than normal light, thus generating a signal of intensity below the normal range. In either case, the condition information (flawed and/or non-flawed) of each full-width scan, based upon detector-generated signal and detector location, is stored in the controller processor of the automatic control system for use some time later in the fabrication process. The data so stored may be in any form that will allow their use at some known number of cycles later in the process, when that particular scanned increment of material reaches the appropriate position in the RIFR and at which the flaw removal mode is begun.

To this point, most of the instant process is known in the art; however, to incorporate the flaw removal mode into the rod insertion process, it was necessary to develop an entirely different and novel process and to design an unique apparatus to perform the procedural steps.

Figure 10B:
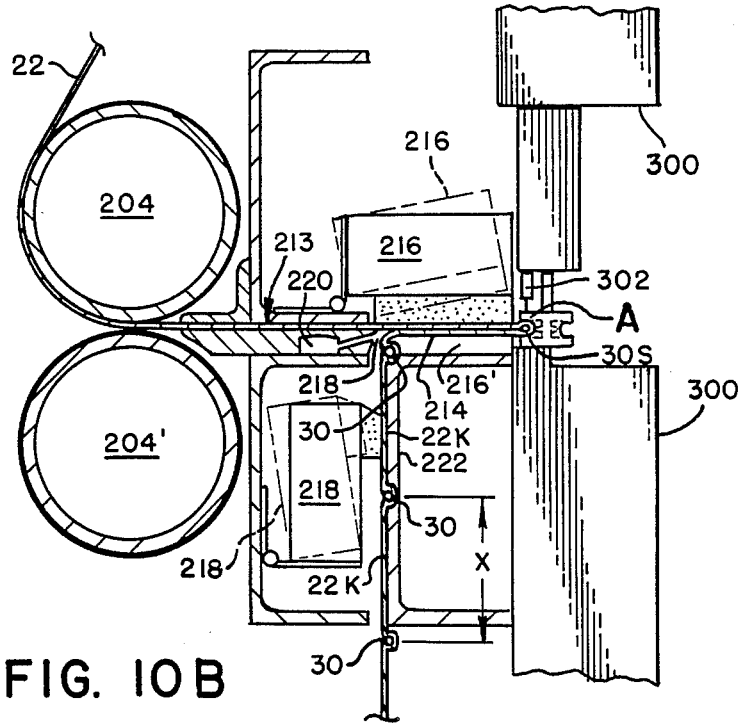
FIG. 10B a schematic drawing of the Rod Insertion-Flaw Removal Station.

The central portion of the RIFR 200 comprises the apparatus used to advance the material 22, form it for insertion of the rod 30, perform any necessary flaw removal and advance the material (with rod inserted) out of the RIFR station to the take-up section 152. Reference being had to FIG. 10B, the reader may observe that the material 22 enters the RIFR station at the left hand side, between the metering rollers 204, specifically the upper step roller and the lower nip roller 204'. It is directed into a transverse channel 213 which is situate essentially horizontal in the RIFR. Thereafter, a thickened channel extension 214 of the front channel 213 is created between the interior table 216' and a transverse pivotable upper plate 216. Upper plate 216 is thus hingeably disposed and traverses the width of extension 214, as well as the width of front channel 213. It is the purpose of this upper plate to provide a means for effecting, and then removing, an upper constraint in the formation of channel extension 214. As the reader will soon be apprised, this facility is mandated by the need to remove the double layer of fabric seen between the upper plate 216 and the lower table 216' once the rod 30S is inserted between layers at index "A". In the preoperational setup, material 22 is taken through channel 213 and directed orthogonally thereto to be brought generally downward over and adjacent guide anvil 222. In so doing, the material passes clamp 218 which, like upper plate 216, is pivotally mounted and runs the width of the RIFR, its purpose being to clamp and temporarily fix material 22 between it and guide anvil 222. At the point at which the material 22 is directed orthogonally out of channel 213, it passes a transverse air port 218. The line of, or a continuous (for the width of the RIFR) port(s) 218 is supplied by air chamber 220 and controlled by the aforementioned automatic controller. It is the function of chamber 220, and its associated port(s) 218, to provide a high intensity air blast for a period as directed by the process controller. At this point in the fabrication sequence, plate 216 has been raised so that in cooperation with table 216', channel extension 214 is formed. Concurrently, lower clamp 218 is in the retracted position (shown by the dashed lines) and the material advances downward as shown. At initiation of the rod insertion sequence, lower clamp 218 closes capturing material 22 between its pad and guide anvil 222. Concurrently, with the immobilization of the material relative to the self tensioning take-up roll, the metering rollers advance the material by a predetermined or preset increment, that is, in the normal fabrication mode, metering rollers 204, 204' advance material 22 precisely by a predetermined amount, in a typically known fashion, into the guide slot or first channel 213. Upper plate 216 is already raised by a predetermined amount, a continuous air blast is provided through air vent 218 and the force of air transversly ejected against the surface of the fabric (which has now been fixed at the lower portion adjacent clamp 218 and freed by the additional advance of material into channel 213), causes the fabric to billow into an inflated loop which propagates along channel extension 214 until it reaches the "A" index immediately outside of the channel. At this point, the amount of material advanced by the metering rollers is fully extended along channels 213 and extension 214 and the air-formed, transverse pocket is at index "A". Upper plate 216, acting as the channel extension 214 upper surface performs its secondary function and clamps the doubled fabric between itself and the machine table 216'.

Figure 11:
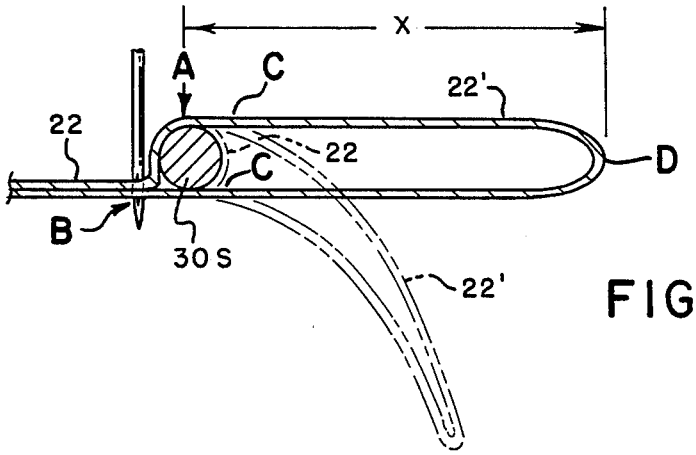
FIG. 11 is a schematic cross section of the fabric with rod inserted and the salient indices disclosed in the method of manufacture.

A pocket having thus been formed in material 22 as depicted in cross section at FIG. 11, a rod 30 is projected by auxiliary apparatus (not disclosed herein) or manually into the pocket at index "A" and the sewing head/needle 302 stitches the two layers of fabric along transverse index "B", as shown. After the stitching process has been completed, plate-clamp 216 and lower clamp 218 are withdrawn and the take-up section 152, take-up roll 156 and tensioners 158 cooperate to remove the rod-inserted section 22K through the open extension channel and down along guide anvil 222. As depicted in FIG. 11, the fabric 22 has been stiffened by the insertion of rod 30S. If it has been necessary to remove a flaw, the fabric has been transversly cut at index "C" and the flawed portion 22' removed by ancillary means that are not shown herein. For a clearer understanding of the flaw removal process, which will be discussed hereinafter, it is suggested that the reader take note of the positions of indices "C" and "D". Their meaning and the value of these references will be appreciated at a point further in this disclosure.

Before proceeding with a description of the flaw removal mode of the instant machine and process invention, it is well for the reader to understand the normal fabricating operation. Summarizing, without reference to the particular elements, and reference being had to FIG. 13 which comprises a sequence flow chart for the normal rod insertion mode and the flaw removal mode, a cycle begins with both upper plate clamp and lower clamp opened, and the material advances under the take-up tension until it is held taut between the take-up and the metering rollers. The lower clamp then closes, releasing the material above it from the influence of the take-up tension. The metering rollers advance the material by the desired preset increment and the material, concurrently driven by the momentum from the air jets located near its orthogonal departure from its advancing direction, billows into an inflated loop proximate the open upper plate clamp. The meter advance distance is so matched with the size of the clamp and its associated parts that, when the upper clamp closes on the loop of material, a portion of that loop protrudes beyond the ends of the clamp and the table (anvil) faces of the channel extension. The protruding portion, that is, the transverse loop in the material receives the stiffening, in this case, rod insertion. Although the clamp has closed, the porosity of the material, and/or relief grooves in the faces of the clamp-table anvil allow air from the jets to escape, urging the continued opening of the protruding loop. A rod is then threaded through the length of the loop (transverse the material) from either a precut-rod feeder, or as preferred, from a continuous roll of rod. A travelling sewing machine, well known in the art, is then activated by a signal generated by the fed-in rod reaching the far side of the material (where it enters a receptacle which holds it in position during material flaw removal—see further in this description). The sewing machine traverses the material, riding guides 304 (see FIG. 10A), stitching between the rod and the adjacent face edges of the plate clamp and table anvil, thus completely capturing the rod in the air-formed loop (pocket). To precisely locate the rod and material, the foot of the sewing machine may be modified to fit around the rod, as in welting or piping practice. When the stitch has been completed across the material (in a single direction), the lower clamp is caused to open; it has been stimulated by a signal generated upon arrival of the sewing machine head, at its end of travel. Concurrent with the lower clamp opening, ancillary apparatus is employed to trim the rod. It is not the purpose of this disclosure, however, to disclose the ancillary rod trimming apparatus at this time. Upper and lower clamps opened, the stiffened material is drawn toward the take-up and, when completely drawn taut into the initial posture of the material, the rod insertion mode is reinitiated.

In the event that a flaw has been located in the advancing material, by means described earlier in this disclosure, a flaw removal mode is entered by the processing control equipment. When the flawed section of material has advanced to where, under normal fabricating mode, it lies within one period of spacing (i.e. a material advance increment x) of the most recently inserted rod, and before the rod is stitched in place, the impending stitch command is aborted, as well as is the normally subsequent lower clamp opening. Instead, the upper plate clamp reopens and the metering rollers advance another normal increment causing more material to billow into a larger loop through and beyond the "A" index to the "D" index shown in FIG. 11. As becomes readily apparent to the reader, the flawed material is contained somewhere within the larger loop, this larger loop beyond the "A" index. Should the flaw be very large, or another flaw detected in the next advancing increment, this special advance cycle can be repeated, as necessary until the material of the next advancing increment is deemed flawless. At that time, the upper plate-clamp closes and the stitching process proceeds according to the normal mode. It should be noted that the rod guide and receptacle, described generally above, will have retained at least the ends of the stiffener rod in the desired position for stitching, even though the enclosing loop of flawed material is too large to aid in rod location. The remaining portion of this description relates to the unique method and apparatus that are used to remove the flaw and mend the fabric about the prepositioned rod so that the normal operating mode might be rapidly reentered and the fabrication process continued.

Figure 12A:
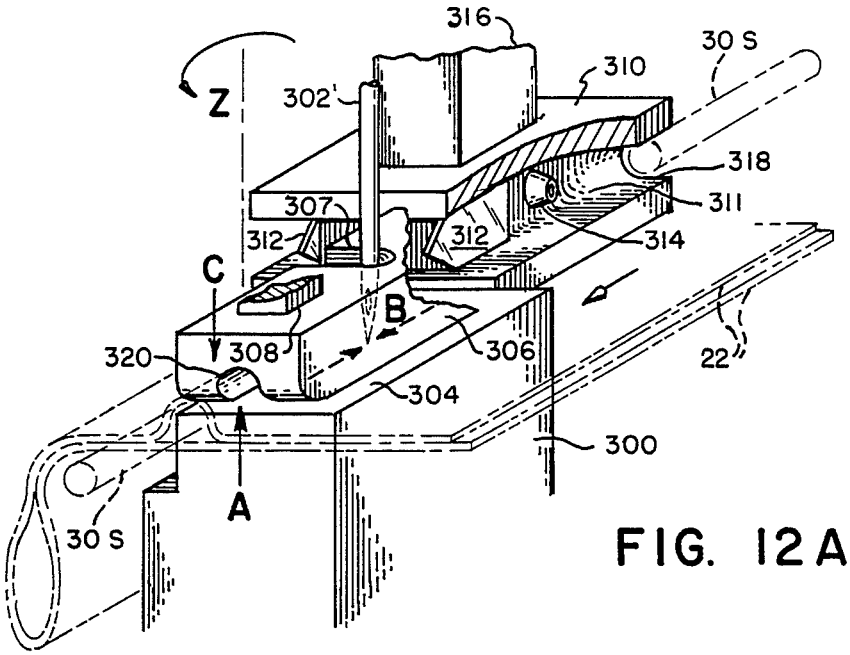
FIG. 12A is a sectionalized isometric illustration of the traveler apparatus.
Figure 12C:
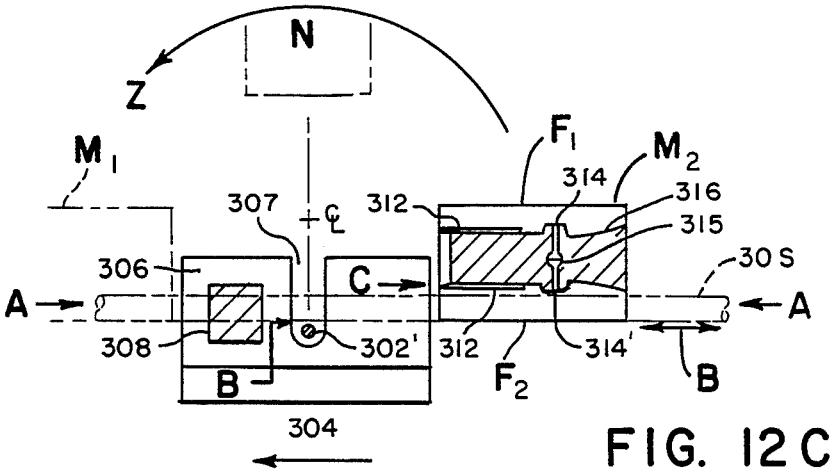
FIG. 12C is a top view of the FIG. 12B apparatus sectioned at 12C, as indicated.
Figure 12B:
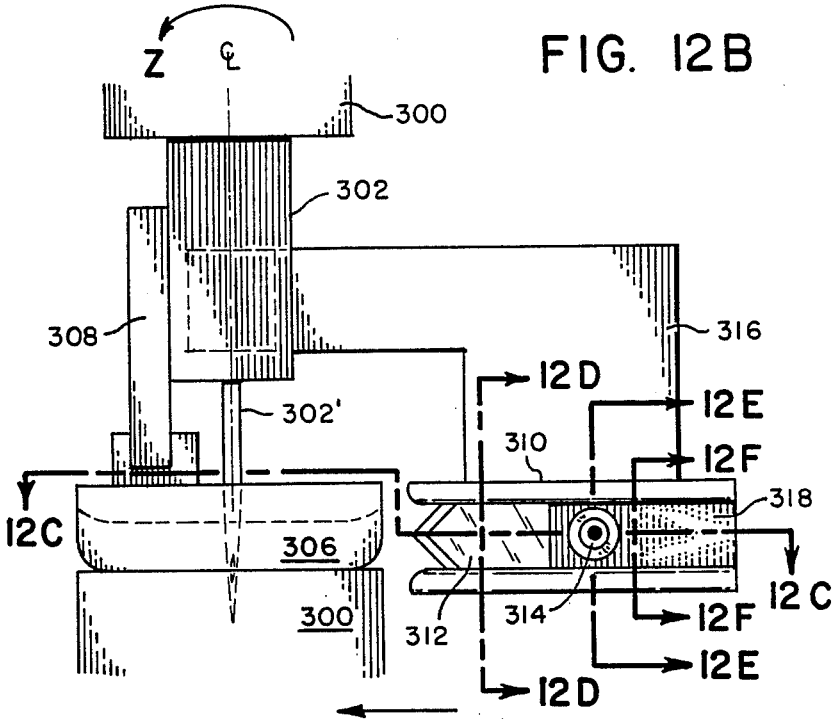
FIG. 12B is a front elevation of the traveler looking into the mender section.

Having seen how the machine proper operates to stiffen the material which is used to manufacture the shade, as well as the process for effecting a flaw removal stage or mode, there now remains the disclosure of matters and apparatus pertaining specifically to the mending of the material once a rod has been set up at the "A" index and the fabric loop extended to the desired limit at the "D" index. The reader should recall that, earlier in this paper, it was stated that the stitching process proceeds at the time that the upper plate-clamp closes according to the normal cycle. As far as the stitching apparatus (sewing machine) is functionally concerned, its function is always performed in the same manner, once the controller or processor signals that the rod is prepared for material capture. This signal will be generated whenever the material reaches the "A" or the "D" index whichever in pertinent in that mode. The stitcher is a standard commercial traversing sewing machine. The salient elements of the sewing machine as will be hereinafter discussed comprise, as shown in FIG. 12A, the foot 306 or boat element, the needle slot 307 located transverse the longitudinal axis of the foot movement, the foot support 308 which provides the requisite guidance and pressure for the foot element and the sewing machine or stitcher needle 302'. Associated with the stitcher, at a location substantially adjacent to the foot but across the rod from the needle (at the "C" index of FIGS. 12A and 12C), is a device which deals with the excess material in the oversized, flawed loops as shown in FIG. 11. After a flaw advance, and as the sewing machine stitches across the material along the "A" index (the reader will note that the A, B and C indices are parallel, transverse indices), this device, called the mender 310, cuts the large, flawed loop both above and below the rod, along the "C" index. Reference is made now to the mender 310 which is disclosed in FIGS. 12A through 12F. The mender is a compound head suspended, as previously noted, adjacent the foot and pivotally suspended from above the foot so that it may, upon command from the controller-processor, effect a 180 degree arc and present its reverse face in registry with the rod, still adjacent the foot, but on its other side. Reference to FIG. 12C will clarify for the reader that mender 310 is indeed symmetrical about its longitudinal center line so that, when traversing in the direction so indicated, face $F_2$ will present first its knife blade 312, followed by the adhesive port 314 and finally by the shaping col 316, the purpose of which will be explained hereinafter. When the mender 310 is configured as shown in FIGS. 12A, 12B and 12C, traversing as shown towards the left of the figures, it is said to be in the mend sub-mode $M_2$. If there is no mending to be effected, the mender head may be moved to the null position, known as the "N" index. If the mend mode is entered when the left-right stitcher is at the left side (of the drawings), then the mend sub-mode $M_1$ is entered and the mender head 310 arcs around past the null index to the $M_1$, presenting face $F_1$ in position along the "C" index. Thus, this unique apparatus allows both a stitching and mending process to take place literally at every sweep from left to right, or right to left. Adhesive material is supplied to adhesive ports 314 through a partitioned supply tube 315. Although not explained in great detail herein, supply tube 315 is partitioned so that the port 314 on face $F_1$ is separated from port 314' on face $F_2$. At the base of supply tube 315 (not herein fully disclosed), are glue inlet ports which are shuttered and which are placed in registry with the main glue supply orifice (not herein shown) adjacent to, and at the base of, the sewing machine 300. This method is utilized as it requires only a single source of glue or adhesive to the machine and it is thereafter manifolded to the bases of supply tube 315, only as the appropriate adhesive port 314 is required to dispense the adhesive. Refering now particularly to FIGS. 12A and 12B, the reader will see that, as the foot 306 and mender head 310 traverse towards the left side of the illustration, the rod 30S having been positioned at the "A" index receives the stitch by needle 302' along the (invisible) "B" index as the rod is held captive at its ends and the fabric 22 held snugly thereabout by the cooperation of the foot 306 channel 320 pressing downward through the urging of its support 308 onto the RIFR anvil 304. It may be seen that, as the sewing machine stitches across the material, the knife cuts the flawed portion at index "C" and immediately thereafter adhesive is expelled through port 314 directly onto the rod 30S surface. Meanwhile, the loose margins of the cut fabric, both top and bottom, are captured in the mender head channel 311 and urged toward the channel 311 termination, the col 318. This channel, as well as the terminating col 318 provide folding guides which wrap the margins of the cut material closely around the rod pressing them into the adhesive. Additional curing aids for the adhesive (e.g., heat, cold, air, light), if required, follow immediately behind the folding guides. The excess, flawed material drops away to be collected and disposed of by the operator. In this manner, the rod is retained much as if by a continuous loop of non-flawed material. Since the stresses of operation (extending, collapsing and sliding) are substantially borne by the stitched seams on the other side of the rods, these adhesively mended loops do not present a weakening effect to the final product. Further, because the adhesively closed loops are essentially the same in size and appearance as the normal loops, no special mating parts requirements, or operational, or aesthetic penalties are incurred.

Figures 12D, 12E, 12F:
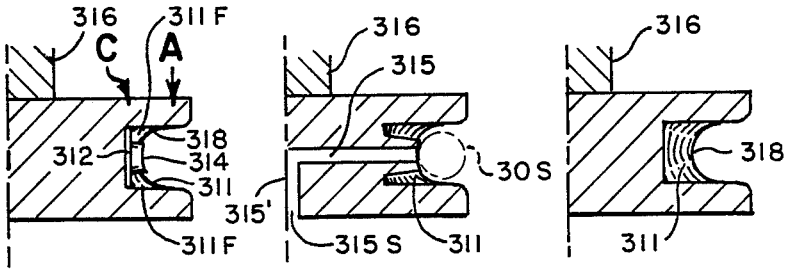
FIGS. 12D, 12E and 12F are cross sections of the mender of FIG. 12B taken at 12D, 12E and 12F showing knife, adhesive port and former, respectively.

For further clarification, and so that the reader might fully appreciate the use of the compound stitcher and mender apparatus, further reference shall be had at this time to the drawings at FIGS. 12B, 12D, 12E and 12F. FIG. 12B, showing the front side of the stitcher and mender head, has been sectioned at 12C, 12D, 12E and 12F. The apparatus of FIG. 12C, having been fully described in conjunction with the isometric illustration of FIG. 12A, shall not be referred to at this time. The reader, in viewing the mender 310 from the front, immediately notices the two most salient elements, the knife 312 and the adhesive port 314. As mentioned earlier, if the machine were traversing to the right, rather than to the left, this figure would be, except for the foot support 308, symmetrically about the center line (C). It can be readily seen here that the support 316 for the mender head 310 may swing about the center line and to be positioned to the left hand side of the foot 306. In FIGS. 12D–12F, the reader sees cross sectional views of the mender head taken through the knife 312, through the adhesive port 314, and through the last one third of the mender channel 311 looking towards the termination of forming col 318, respectively. The knife 312, as seen in FIG. 12D, is positioned at the "C" index, while the terminal portion of the col 318 is approximately one rod 30 radius behind the "A" index. Referring to FIG. 12E, the viewer sees the mender head in cross section at the adhesive port 314. Contiguous with the port is the glue or adhesive supply channel 315, represented here in its orthogonal placement within the mender head. The reader will note that partition 315' divides the vertically rising adhesive supply 315S to 315. The purpose for this partition was described earlier and discussed more fully during the explanation of FIG. 12C. Also, in FIG. 12E, the reader will notice that rod 30S (shown in phantom) is, for all practical purposes, in registry with the outer surface of adhesive port 314. Again, as mentioned earlier, the glue or adhesive is applied directly to the surface of the exposed rod during the mending process. Finally, the reader's attention is called to FIG. 12F where, in this cross section of the latter third of the mender head 310, the forming channel 311 is seen more clearly terminating at the forming col 318. It can be readily deduced that fabric margins, overlying rod 30S and adjacent to the upper and lower portions of channel 311 would be urged about the rod by the smooth transition from the flat portion 311F of channel 311 as seen in FIG. 12D to the completely semi-circular shape seen at col 318 of FIG. 12F.

Figure 13:
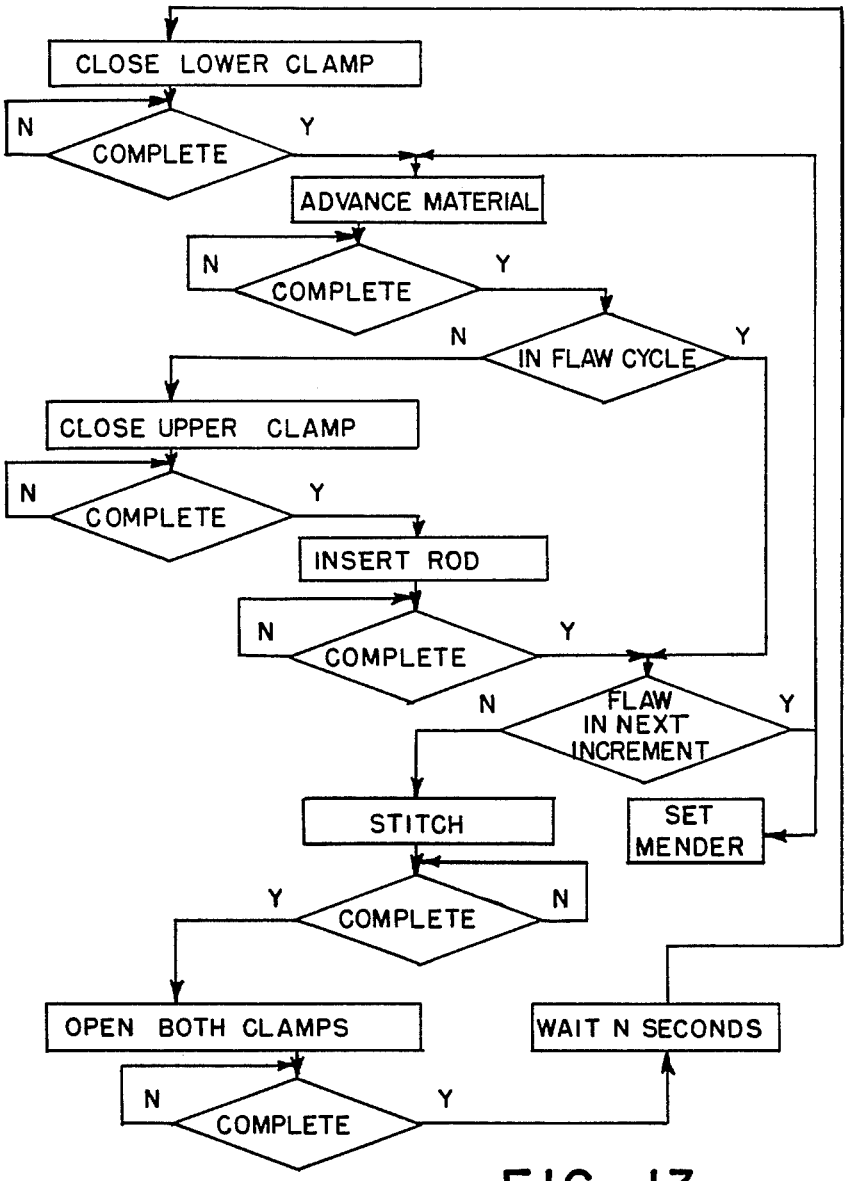
FIG. 13 is the sequence flow chart for the process Performed by the Rod Insertion-Flaw Removal Station mechanism of the instant invention.

Having fully explained the apparatus and the general process for producing the preferred embodiment of the instant invention, along with the methods preferred by the inventors for removing flaws from the supplied fabric or material, the instant inventors would now briefly summarize the entire process beginning with the entering of the material into the RIFR 200, subsequent to the flaw detection operation. FIG. 13, is a flow chart which distinctly describes the salient steps in the normal fabrication mode and in the flaw removal mode. Beginning with the closing of the lower clamp, the computer of controller (processor) queries for a completed step and, upon receiving assurance of its complete execution, commands an advance of the material under normal mode condition. Once completed, the processor determines if the machine is in normal mode or flaw cycle and, if in normal, closes the upper clamp and, upon proper completion of that step commands the insertion of the rod. Had a flaw been detected during the query on flaw cycle, a logic joining point would be experienced and the processor would query whether a flaw exists in the next increment Should a flaw exists in the next increment, the sequence regresses to the material advance step and the entire process (from advance) is repeated simultaneously, a signal is generated to set the mender head so that when the stitch activity is performed, the mending process, as described earlier in this disclosure, will be actuated once the processor is signaled that no (additional) flaw exists in the next increment the program sequences to the stitch operation and, upon its successful completion (with mending, if required), opens both clamps and trims the rod ends (as discussed earlier). Upon assurance that the clamp opening has been successfully completed, the machine controller dwells an appropriate amount of time and sequences back to the beginning of this process.

The reader will note that little reference was made during the entire text of this disclosure, to the persons or manufacturer of ordinary skill. This was not without purpose, because the applicants, having long been associated with window treatments and coverings, as well as the manufacture of such goods and the machines for such manufacture, know of no extant device that is capable of placing stiffeners in a continuous run of material in an accurate, parallel spacing, while automatically detecting and removing flawed material without interruption of or penalty in the finished product. It is their intention therefore to secure exclusive rights to the practice of this invention and, more specifically, to the construction and use of the machinery described herein subject only to the appended claims.

What is claimed is:

1. A shade for covering framed openings comprising:

a pair of tracks disposed opposite and essentially parallel each other along the sides of a framed opening, said tracks bearing on at least one side thereof detented traction means;

movable header means mounted transversely across said opening for movement along said tracks, said header having first and second pairs of wheels, each pair rotatably secured at each end of said header means and engagable with a track, each of said wheel pairs having an interior wheel adapted to travel on one side of a track and an opposing, closely biased exterior wheel adapted to travel on an opposite side of the track, at least one wheel in said first wheel pair mechanically coupled to a wheel in said second wheel pair to compel uniformly coupled movement of said wheel pairs along said tracks; and a flexible shade attached at one marginal end to a fixed sill of said opening and, at an opposite marginal end, to said header means and containing therein, at regularly spaced intervals, a plurality of parallel stiffener rods, said rods also disposed transversely to said tracks and having slotted ends adapted to slidably and partially encompass a portion of said track, whereby when urged by said header means, said shade extends or collapses relative to said fixed sill supported by the movable, track-encompassing, shade stiffener rods.

2. The invention of claim 1 wherein each of said tracks comprises a single continuous projecting flange with traction means on at least one side of a thin, flat edge which projects toward an opposing track and wherein at least one of said wheels in a wheel pair comprises means for engaging traction means on each said track.

3. The invention of claim 1 wherein said pair of tracks further comprises at least one flat, elongate, curvilinear strip of material that has disposed longitudinally thereon a series of detents adjacent a thin, essentially flat and smooth flange thereof, said detents adapted for accepting registry therewith a cog means and said flange adapted for partial and slidable encirclement by end cap flange-engaging means.

4. The invention of claim 3 further comprising a track having integrally formed therein anchoring means, said anchoring means adapted for insertion into and capture by lateral frame means which has therein jawlike groove means for capturing and fixidly securing said anchoring means.

5. A foldable and extensible shade for covering vertical and horizontal openings comprising:

a pair of parallel flat, elongate and curvilinear tracks fixed along side framing of an opening, each of said tracks disposed and projecting a thin flat portion toward the other track while rooted to its respective side frame;

movable header means mountable in said opening and disposed on said tracks, said header means adapted to move along the tracks; and a flexible shade having two marginal ends, one end attached to said fixed sill and the other end attached to and motivated by said header means, said shade containing therein a plurality of parallel stiffener rods, said rods disposed transversely relative to said tracks, with ends of each rod slotted to partially surround said flat portion of a track, whereby urging motion of said movable header causes said shade to be extended or foldably gathered from or towards said fixed sill, wherein shade support is afforded by said rods and shade motion guidance is provided by said rod ends moving over and engaging said tracks.

6. The invention of claim 5 wherein said tracks further comprise traction means on at least one side of a lateral edge which projects toward an opposing track and at least one wheel in a wheel pair comprises means for engaging the traction means on each said track.

7. The invention of claim 6 wherein said slotted ends of said rods further comprise horizontally disposed "U" shaped rod end caps for partially enveloping a portion of a track.

8. The invention of claim 5 wherein said pair of tracks further comprises at least one flat, elongate, curvilinear strip of material that has disposed longitudinally thereon a series of detents adjacent a thin, essentially flat and smooth flange thereof, said detents adapted for accepting registry therewith a cog means and said flange adapted for partial and slidable encirclement by end cap flange-engaging means.

9. The invention of claim 8 further comprising a track having integrally formed therein anchoring means, said anchoring means adapted for insertion into and capture by lateral frame means which has therein jawlike groove means for capturing and fixidly securing said anchoring means.

10. A collapsible-extensible shade for use with a dual, parallel track, shade guidance system, that is disposed on a frame, comprising a length of flexible, foldable, planar fabric containing at regular intervals a plurality of parallel semi-rigid rods transversely disposed across said length of fabric, said rods having at each end thereof support-guides comprising rod ends defining flange-engaging means for effecting sliding engagement with, and support on, a single flange; and a continuous track having a flat single, projecting flange therealong, whereby lengthwise motivation applied to said fabric causes it to gatherably fold and unfold between said rods and along the tracks with which said support-guides engage.

11. The invention of claim 10 wherein said flange engaging means defines slotted rod end caps for engaging said flat, single, projecting flange, thereby compelling said rod to maintain constant and slidable disposition on the track.

12. The invention of claim 11 further comprising rod end caps having offset and generally "U" shaped slots for engaging a continuous, single, essentially flat track projection.

13. The rod end caps of claim 11 further comprising cord retainer means therein, said retainer means adjacent said slots.

14. The invention of claim 10 further comprising a strain cord which connects the support-guides arrayed along lateral edges of said shade.

15. The invention of claim 10 wherein said dual, parallel track, shade guidance system further comprises at least one flat, elongate, curvilinear strip of material that has disposed longitudinally thereon a series of detents adjacent an essentially flat, thin and smooth flange thereof, said detents adapted for accepting registry therewith a cog means and said flange adapted for partial and slidable encirclement by end cap flange-engaging means.

16. The invention of claim 15 further comprising a track having integrally formed therein anchoring means, said anchoring means adapted for insertion into and capture by lateral frame means which has therein jawlike groove means for capturing and fixidly securing said anchoring means.

* * * * *